US012672669B2

(12) United States Patent
Brinkman et al.

(10) Patent No.: US 12,672,669 B2
(45) Date of Patent: Jul. 7, 2026

(54) ADAPTOR DEVICES FOR USE IN EMISSIONS TESTING OF SMOKING OR VAPING PRODUCTS AND METHODS OF USE

(71) Applicant: Ohio State Innovation Foundation, Columbus, OH (US)

(72) Inventors: Marielle Brinkman, Columbus, OH (US); Theodore Wagener, Powell, OH (US); Jason Robinson, Columbus, OH (US); Jeremy Jones, Johns Creek, GA (US); Ryan Petitti, Columbus, OH (US); Clint Fleshman, Columbus, OH (US); Brittney Keller-Hamilton, Columbus, OH (US); Gary Allread, Columbus, OH (US)

(73) Assignee: Ohio State Innovation Foundation, Columbus, OH (US)

( * ) Notice: Subject to any disclaimer, the term of this patent is extended or adjusted under 35 U.S.C. 154(b) by 0 days.

(21) Appl. No.: 19/114,040

(22) PCT Filed: Sep. 21, 2023

(86) PCT No.: PCT/US2023/033360

§ 371 (c)(1),
(2) Date: Mar. 21, 2025

(87) PCT Pub. No.: WO2024/064269

PCT Pub. Date: Mar. 28, 2024

(65) Prior Publication Data

US 2026/0000106 A1 Jan. 1, 2026

Related U.S. Application Data

(60) Provisional application No. 63/524,427, filed on Jun. 30, 2023, provisional application No. 63/408,640, filed on Sep. 21, 2022.

(51) Int. Cl.
*A24C 5/34* (2006.01)
*A24F 40/80* (2020.01)

(52) U.S. Cl.
CPC ..... *A24C 5/3406* (2013.01); *A24F 40/80* (2020.01)

(58) Field of Classification Search
None
See application file for complete search history.

(56) References Cited

U.S. PATENT DOCUMENTS 4,400,972 A 8/1983 Wiethaup
4,627,448 A 12/1986 Kamm et al.
(Continued)

FOREIGN PATENT DOCUMENTS

CA 2518174 A1 11/2004
CN 205352882 U 6/2016
(Continued)

OTHER PUBLICATIONS

International Searching Authority. International Search Report and Written Opinion issued in PCT Application No. PCT/US2023/033360 on Feb. 2, 2024. 11 pages.
(Continued)

*Primary Examiner* — Mark A Shabman
(74) *Attorney, Agent, or Firm* — Meunier Carlin & Curfman LLC

(57) ABSTRACT

A smoking machine adaptor device including a base configured to couple to a smoking machine, the base defining a central axis and a base cavity, a cap including a cap flange defining a cap aperture, and a cap actuator coupled to the base and configured to move the cap flange relative to the base along the central axis between a first position to a second position, and a resiliently deformable ferrule sized to be received within the base cavity and defining a ferrule
(Continued)

aperture aligned axially with the cap aperture along the central axis. The ferrule aperture defines a. first ferrule area in a plane perpendicular to the central axis when the cap flange is in the first position, a. second, smaller ferrule area in the plane perpendicular to the central axis when the cap flange is in the second position.

19 Claims, 27 Drawing Sheets

(56) References Cited

U.S. PATENT DOCUMENTS

| | | | | |
|---|---|---|---|---|
| 4,912,964 | A * | 4/1990 | Ohtsuki | G01N 15/0826 73/38 |
| 5,117,845 | A * | 6/1992 | Poulet | A24C 5/3406 131/330 |
| 5,324,271 | A * | 6/1994 | Abiuso | A61M 39/0613 604/167.03 |
| 5,389,090 | A * | 2/1995 | Fischell | A61M 25/0662 604/533 |
| 5,693,025 | A * | 12/1997 | Stevens | A61M 39/1055 604/167.03 |
| 8,272,671 | B2 * | 9/2012 | Becker | F16L 19/12 285/342 |
| 2004/0143892 | A1 * | 7/2004 | Bantz | E03C 1/24 4/295 |
| 2006/0130860 | A1 | 6/2006 | Cholet | |
| 2008/0257368 | A1 * | 10/2008 | Wilson | A24C 5/3406 131/330 |
| 2016/0302484 | A1 | 10/2016 | Gupta et al. | |
| 2017/0050778 | A1 * | 2/2017 | Kobylinski | B65D 55/14 |
| 2019/0014817 | A1 * | 1/2019 | Melvin | A24F 13/08 |
| 2020/0355660 | A1 * | 11/2020 | Smith | A24F 40/40 |
| 2022/0071307 | A1 * | 3/2022 | Smith | G01D 11/24 |

FOREIGN PATENT DOCUMENTS

| | | |
|---|---|---|
| EP | 3 110 266 A1 | 1/2017 |
| GB | 2 423 461 A | 8/2006 |

OTHER PUBLICATIONS

International Preliminary Examining Authority. International Preliminary Report on Patentability issued in PCT Application No. PCT/US2023/033360 on Aug. 30, 2024. 8 pages.

Popova, et al., "Light and Mild Redux: Heated Tobacco Products' Reduced Exposure Claims Are Likely to Be Misunderstood as Reduced Risk Claims", Tobacco control, vol. 27, Issue Suppl. 1, pp. s87-s95, Sep. 12, 2018.

Prochaska, et al., "Nicotine Delivery and Cigarette Equivalents from Vaping a JUULpod", Tobacco Control, vol. 31, No. e1, pp. e88-e93, Mar. 24, 2021.

Queimado, et al., "Electronic Cigarette Aerosols Induce DNA Damage and Reduce DNA Repair: Consistency Across Species", Proceedings of the National Academy of Sciences, vol. 115, No. 24, pp. E5437-E5438, Jun. 12, 2018.

Ratajczak, et al., "Heat Not Burn Tobacco Product—A New Global Trend: Impact of Heat-Not-Burn Tobacco Products on Public Health, a Systematic Review", International Journal of Environmental Research and Public Health, vol. 17, No. 2, 12 pages, Jan. 8, 2020.

Robinson, et al., "A Comparison Between Cigarette Topography from a One-Week Natural Environment Study to FTC/ISO, Health Canada, and Massachusetts Department of Public Health Puff Profile Standards", International Journal of Environmental Research and Public Health, vol. 17, No. 10, 10 pages, May 15, 2020.

Sarles, et al., "Surveillance of U.S. Corporate Filings Provides a Proactive Approach to Inform Tobacco Regulatory Research Strategy", International Journal of Environmental Research and Public Health, vol. 18, No. 6, 20 pages, Jan. 25, 2021.

Shihadeh, et al., "A Closed-Loop Control "Playback" Smoking Machine for Generating Mainstream Smoke Aerosols", Journal of Aerosol Medicine, vol. 19, No. 2, pp. 137-147, Jun. 23, 2006.

Shihadeh, et al., "Significance of Smoking Machine Toxicant Yields to Blood-Level Exposure in Water Pipe Tobacco Smokers", Cancer Epidemiology, Biomarkers and Prevention, vol. 20, No. 11, pp. 2457-2460, Sep. 13, 2011.

Sterling, et al., "Association Between Menthol-Flavoured Cigarette Smoking and Flavoured Little Cigar and Cigarillo Use Among African-American, Hispanic, and White Young and Middle-aged Adult Smokers", Tob Control, vol. 25, Issue Suppl. 2, pp. ii21-ii31, Oct. 7, 2016.

Tackett, et al., "E-Cigarette Regulation: A Delicate Balance for Public Health", Addiction, 115, No. 12, pp. 2197-2199, Apr. 19, 2020.

Talih, et al., "Electrical Features, Liquid Composition and Toxicant Emissions From 'pod-mod'-like Disposable Electronic Cigarettes", Tobacco Control, vol. 31, No. 5, 9 pages, May 12, 2021.

Tindall, et al., "Smoking Machine Design and Yield Errors Under Intense Smoke Regimes. Part 1: The Influence of Dead Volume on Yield", TSRC—Tobacco Science Research Conference, Available from: https://www.coresta.org/sites/default/files/abstracts/2012BSSPT06BTindall.pdf, 34 pages, 2012.

University of Kentucky, "Center for Tobacco Reference Products", Certificate of Analysis 1R6F Certified Reference Cigarette, 3 pages, Nov. 3, 2022.

Villanti, et al., "Menthol Cigarettes and Mortality: Keeping Focus on the Public Health Standard", Nicotine & Tobacco Research, vol. 15, No. 2, pp. 617-618, Feb. 2013.

Virgili, et al., "E-Cigarettes and Youth: An Unresolved Public Health Concern", Italian Journal of Pediatrics, vol. 48, No. 1, Article 97, 10 pages, Jun. 14, 2022.

Vu, et al., "Polycyclic Aromatic Hydrocarbons in the Mainstream Smoke of Popular US Cigarettes", Chemical research in toxicology, vol. 28, No. 8, 26 pages, Jul. 9, 2015.

Wagener, et al., "Examining the Smoking and Vaping Behaviors and Preferences of Vape Shop Customers", Tobacco Prevention & Cessation, vol. 2, Issue Suppl. 5, 7 pages, 2016.

Wagener, et al., "Have Combustible Cigarettes Met Their Match? The Nicotine Delivery Profiles and Harmful Constituent Exposures of Second-generation and Third-Generation Electronic Cigarette Users", Tobacco Control, vol. 26, Issue e1, pp. e23-e28, 2017.

Wang, et al., "Tobacco Product Use and Associated Factors Among Middle and High School Students—United States, 2019", Morbidity and Mortality Weekly Report Surveillance Summaries, vol. 68, No. 12, pp. 1-22, Dec. 6, 2019.

Watson, et al., "Determination of Tar, Nicotine, and Carbon Monoxide Yields in the Smoke of Bidi Cigarettes", Nicotine & Tobacco Research, vol. 5, No. 5, pp. 747-753, Oct. 2003.

Zou, et al., "Response of Eight Low-Cost Particle Sensors and Consumer Devices to Typical Indoor Emission Events in a Real Home (ASHRAE 1756-RP)", Science and Technology for the Built Environment, vol. 26, No. 2, pp. 237-249, 2020.

Hamad, et al. "Little cigars vs 3R4F cigarette: physical properties and HPHC yields." Tobacco regulatory science 3.4 (2017): 459.

NCI. The FTC Cigarette Test Method for Determining Tar, Nicotine, and Carbon Monoxide Yields of U.S. Cigarettes. Report of the NCI Expert Committee. Tobacco Control Monograph No. 7. Bethesda, MD: U.S. Department of Health and Human Services, National Institutes of Health, National Cancer Institute. NIH Pub. No. 96-4028, Aug. 1996. 306 pages. [Nov. 3, 2022]. Available from: https://cancercontrol.cancer.gov/brp/tcrb/monographs/monograph-07.

Adetona, et al., "Do They Differ? Flavored Versus Unflavored Waterpipe Tobacco Flavor Ingredients", Nicotine & Tobacco Research, vol. 6, No. 5, 19 pages, 2020.

Appel, et al., "Benzene, Benzo(a)pyrene, and Lead in Smoke from Tobacco Products Other Than Cigarettes", American Journal of Public Health, vol. 80, No. 5, pp. 560-564, May 1990.

Benowitz, Neal L., "The Central Role of pH in the Clinical Pharmacology of Nicotine: Implications for Abuse Liability, Cigarette Harm Reduction and FDA Regulation", Clinical Pharmacology and Therapeutics, vol. 111, No. 5, 6 pages, May 2022.

(56) References Cited

OTHER PUBLICATIONS

Berg, et al., "Correlates of Allowing Alternative Tobacco Product or marijuana use in the homes of young Adults", Pediatrics, vol. 141, Issue Suppl. 1, 16 pages, Aug. 8, 2018.
Breland, et al., "Electronic Cigarettes: What Are They and What Do They Do?", Annals of the New York Academy of Sciences, vol. 1394, No. 1, pp. 5-30, 2017.
Brinkman, et al., "Comparison of True and Smoothed Puff Profile Replication on Smoking Behavior and Mainstream Smoke Emissions. Chemical Research in Toxicology", Chemical Research in Toxicology, vol. 28, No. 2, pp. 182-190, 2015.
Brinkman, et al., "Effect of Electric Heating and Ice Added to the Bowl on Mainstream Waterpipe Semivolatile Furan and Other Toxicant Yields", Tobacco Control, vol. 29, Issue Suppl. 2, pp. s110-s116, Sep. 21, 2019.
Brinkman, et al., "Evidence of Compensation Among Waterpipe Smokers Using Harm Reduction Components", Tobacco Control, vol. 29, Issue 1, 9 pages, Oct. 30, 2018.
Brinkman, et al., "Exposure to and Deposition of Fine and Ultrafine Particles in Smokers of Menthol and Nonmenthol Cigarettes", Inhalation Toxicology, vol. 24, No. 5, pp. 255-269, Apr. 10, 2012.
Brokl, et al., "Multivariate Analysis of Mainstream Tobacco Smoke Particulate Phase by Headspace Solid-phase Micro Extraction Coupled with Comprehensive Two-Dimensional Gas Chromatography—Time-of-Flight Mass Spectrometry", Journal of Chromatography A, vol. 1370, pp. 216-229, Nov. 28, 2014.
Calafat, et al., "Determination of Tar, Nicotine, and Carbon Monoxide Yields in the Mainstream Smoke of Selected International Cigarettes", Tobacco Control, vol. 13, No. 1, pp. 45-51, Mar. 2004.
Caudill, et al., "Multi-Rule Quality Control for the Age-related Eye Disease Study", Statistics in Medicine, vol. 27, No. 20, pp. 4094-4106, Mar. 14, 2008.
Cerulean, "Smoking Accessories", Available online at URL—[https://www.cerulean.com/en/solutions/product/smoking-accessories], 6 pages, Retrieved on Jun. 24, 2025.
Cai, et al., "Emission level of Seven Mainstream Smoke Toxicants from Cigarette with Variable Tobacco Leaf Constituents", Regulatory Toxicology and Pharmacology, vol. 103, pp. 181-188, Apr. 2019.
Coresta, "2015 Collaborative Study for Determination of Glycerin, Propylene Glycol, Water and Nicotine in Collected Aerosol of E-Cigarettes", Technical Report, https://www.coresta.org/2015-collaborative-study-determination-glycerin-propylene-glycol-water-and-nicotine-collected-30486, 52 pages, 2021.
Coresta, "Cigar Smoke Analysis 14th Collaborative Study 2019-2020", CSM Technical Report, 62 pages, Apr. 2021.
Crenshaw, et al., "Determination of Nicotine, Glycerol, Propylene Glycol and Water in Electronic Cigarette Fluids Using Quantitative 1H NMR", Magnetic Resonance in Chemistry, vol. 54, Issue 11, pp. 901-904, Aug. 24, 2016.
Darrall, Keith G., "Smoking Machine Parameters and Cigarette Smoke Yields", Science of the Total Environment, vol. 74, pp. 263-278, Aug. 1, 1988.
El-Kaassamani, et al., "Analysis of Mainstream Emissions, Secondhand Emissions and the Environmental Impact of IQOS Waste: a Systematic Review on IQOS that Accounts for Data Source", Tob Control, vol. 33, pp. 93-102, May 13, 2022.
Food and Drug Administration, "Deeming Tobacco Products to Be Subject to the Federal Food, Drug, and Cosmetic Act, as Amended by the Family Smoking Prevention and Tobacco Control Act; Restrictions on the Sale and Distribution of Tobacco Products and Required Warning Statements for Tobacco Products", Federal Register, vol. 81, No. 90, pp. 28974-29106, May 10, 2016.
Food and Drug Administration, "FDA Finalizes Enforcement Policy on Unauthorized Flavored Cartridge-Based E-Cigarettes That Appeal to Children, Including Fruit and Mint", Available from: https://www.fda.gov/news-events/press-announcements/fda-finalizes-enforcement-policy-unauthorized-flavored-cartridge-based-e-cigarettes-appeal-children, 6 pages, 2020.
Food and Drug Administration, "FDA Makes Significant Progress in Science-Based Public Health Application Review, Taking Action on Over 90% of More Than 6.5 Million 'Deemed' New Tobacco Products Submitted", Available online at URL—[https://www.fda.gov/news-events/press-announcements/fda-makes-significant-progress-science-based-public-health-application-review-taking-action-over-90], 4 pages, 2021.
Food and Drug Administration, "Harmful and Potentially Harmful Constituents in Tobacco Products and Tobacco Smoke; Established List", Federal Register, vol. 77, No. 64, pp. 20034-20037, Apr. 3, 2012.
Food and Drug Administration, "Harmful and Potentially Harmful Constituents in Tobacco Products; Established List; Proposed Additions; Request for Comments", Federal Register, vol. 84, No. 150, pp. 38032-38035, Aug. 5, 2019.
Gaiha, et al., "E-Cigarette Devices, Brands, and Flavors Attract Youth: Informing Fda's Policies and Priorities to Close Critical Gaps", Addictive Behaviors, vol. 126, 22 pages, Mar. 2022.
Gentzke, et al., "Vital Signs: Tobacco Product Use Among Middle and High School Students—United States, 2011-2018", Morbidity and Mortality Weekly Report, vol. 68, No. 6, pp. 157-164, Feb. 15, 2019.
Gordon, et al., "Effect of Cigarette Menthol Content on Mainstream Smoke Emissions", Chemical Research in Toxicology, vol. 24, No. 10, pp. 1744-1753, Sep. 2, 2011.
Haddad, et al., "Reactive Oxygen Species Emissions from Supra- and Sub-ohm Electronic Cigarettes", Journal of Analytical Toxicology, vol. 43, No. 1, pp. 45-50, Sep. 6, 2018.
Hamad, et al., "Little Cigars vs 3R4F Cigarette: Physical Properties and HPHC Yields", Tobacco Regulatory Science, vol. 3, No. 4, 20 pages, 2017.
Harrell, et al., "Flavored Tobacco Product Use Among Youth and Young Adults: What if Flavors Didn't Exist?", Tobacco Regulatory Science, vol. 3, No. 2, 9 pages, Apr. 1, 2017.
Hoffmann, et al., "The Changing Cigarette, 1950-1995", Journal of Toxicology and Environmental Health, vol. 50, No. 4, pp. 307-364, Mar. 1, 1997.
Hoffmann, et al., "The Less Harmful Cigarette: A Controversial Issue. A Tribute to Ernst L. Wynder", Chemical Research in Toxicology, vol. 14, No. 7, pp. 767-790, Jul. 2001.
Klupinski, et al., "Identification of New and Distinctive Exposures from Little Cigars", Chemical Research in Toxicology, vol. 29, No. 2, 16 pages, Feb. 15, 2016.
Leavens, et al., "Polytobacco Use and Risk Perceptions Among Young Adults: The Potential Role of Habituation to Risk", Addictive behaviors, vol. 90, 15 pages, Mar. 2019.
Lechner, et al., "The Comparative Efficacy of First-versus Second-Generation Electronic Cigarettes in Reducing Symptoms of Nicotine Withdrawal", Addiction, vol. 110, No. 5, pp. 862-867, May 2015.
Lisko, et al., "Chemical Composition and Evaluation of Nicotine, Tobacco Alkaloids, pH, and Selected Flavors in E-Cigarette Cartridges and Refill Solutions", Nicotine & Tobacco Research, vol. 17, No. 10, pp. 1270-1278, Jan. 30, 2015.
Liu, et al., "Comparison of Mainstream Smoke Yields between Linear and Rotary Smoking Machines and Evaluation of "Super Pad" Extraction for Linear Smoking Machines", Chemical Research in Toxicology, vol. 34, No. 7, pp. 1713-1717, Jul. 6, 2021.
Lu, et al., "The Emission of VOCs and CO from Heated Tobacco Products, Electronic Cigarettes, and Conventional Cigarettes, and Their Health Risk", Toxics, vol. 10, No. 1, 16 pages, Dec. 28, 2021.
MacGregor, et al., "Custom Mentholation of Commercial Cigarettes for Research Purposes", Toxicology Reports, vol. 1, pp. 1068-1075, Oct. 22, 2014.
McAdam, et al., "Influence of Machine-Based Puffing Parameters on Aerosol and Smoke Emissions from Next Generation Nicotine Inhalation Products", Regulatory Toxicology and Pharmacology, vol. 101, pp. 156-165, Feb. 2019.
Mikheev, et al., "Real-Time Measurement of Electronic Cigarette Aerosol Size Distribution and Metals Content Analysis", Nicotine & Tobacco Research, vol. 18, No. 9, pp. 1895-1902, May 4, 2016.

(56) References Cited

OTHER PUBLICATIONS

Oldham, et al., "Particle Size Distribution of Selected Electronic Nicotine Delivery System Products", Food and Chemical Toxicology, vol. 113, pp. 236-240, Jan. 31, 2018.
Omaiye, et al., "High-Nicotine Electronic Cigarette Products: Toxicity of JUUL Fluids and Aerosols Correlates Strongly with Nicotine and Some Flavor Chemical Concentrations", Chemical Research in Toxicology, vol. 32, No. 6, 12 pages, Mar. 21, 2019.
Pankow, et al., "Gas/Particle Partitioning Constants of Nicotine, Selected Toxicants, and Flavor Chemicals in Solutions of 50/50 Propylene Glycol/Glycerol as Used in Electronic Cigarettes", Chemical Research in Toxicology, vol. 31, Issue 9, 16 pages, Aug. 16, 2018.
Pappas, et al., "Cadmium, Lead, and Thallium in Smoke Particulate from Counterfeit Cigarettes Compared to Authentic Us Brands", Food and Chemical Toxicology, vol. 45, No. 2, pp. 202-209, Feb. 2007.
Peeler, C.L., "Cigarette Testing and the Federal Trade Commission: A Historical Overview", Chapter 1, The FTC Cigarette Test Method for Determining Tar, Nicotine, and Carbon Monoxide Yields of U.S. Cigarettes, Smoking and Tobacco Control Monograph No. 7, pp. 1-8, 1996.
Perez, et al., "Isotope-Dilution Gas Chromatography-Mass Spectrometry Method for the Selective Detection of Nicotine and Menthol in E-Cigarette, or Vaping, Product Liquids and Aerosols", Frontiers in Chemistry, vol. 9, Article 754096, 6 pages, Sep. 27, 2021.
Pericot-Valverde, et al., "Examination of a Mouthpiece-Based Topography Device for Assessing Relative Reinforcing Effects of E-Cigarettes: A Preliminary Study", Experimental and Clinical Psychopharmacology, vol. 28, No. 1, 12 pages, 2020.
Pichelstorfer, et al., "Simulation of Aerosol Dynamics and Deposition of Combustible and Electronic Cigarette Aerosols in the Human Respiratory Tract", Journal of Aerosol Science, vol. 99, pp. 125-132, May 4, 2016.
Plesser, Hans E., "Reproducibility vs. Replicability: A Brief History of a Confused Terminology", Frontiers in Neuroinformatics, vol. 11, Article 76, 4 pages, Jan. 18, 2018.

* cited by examiner

ADAPTOR DEVICES FOR USE IN EMISSIONS TESTING OF SMOKING OR VAPING PRODUCTS AND METHODS OF USE

CROSS-REFERENCE TO RELATED APPLICATIONS

This application is a national stage application filed under 35 U.S.C. § 371 of PCT/US2023/033360 filed Sep. 21, 2023, which claims priority to U.S. Provisional Patent Application Ser. No. 63/408,640, filed Sep. 21, 2022, and U.S. Provisional Patent Application Ser. No. 63/524,427, filed Jun. 30, 2023, each of which is incorporated herein by reference in their entirety.

STATEMENT REGARDING FEDERALLY SPONSORED RESEARCH OR DEVELOPMENT

This invention was made with government support under grant/contract number UC2 FD007229 awarded by the Food and Drug Administration. The government has certain rights in the invention.

BACKGROUND

The present disclosure relates generally to smoking machines used to test smoking devices (e.g., cigarettes, cigars, electronic cigarettes, heated tobacco devices, and other nicotine delivery devices).

Linear smoking machines receive and perform tests on smoking devices (e.g., cigarettes). The smoking machines connect to and puff on cigarettes for the purpose of analyzing the composition of emissions that come out of the mouth end (or "mouthpiece") of the smoking device. Cigarettes have a fairly standardized geometry and weight, and they connect to the smoking machine using an adaptor that makes a reliable, leak-free seal with them during puffing, so that a repeatable and precise volume is taken through the product for each puff.

Recently, so-called novel inhaled tobacco products (e.g., electronic cigarettes of varied brands and designs) that have a much wider range of geometries and sizes have entered the market. Thus, there is a need for a universal adaptor/interface that reliably seals to these products.

SUMMARY

The systems, methods, and devices disclosed herein provide for a universal smoking machine adaptor able to accommodate a wide range of smoking and/or vaping devices. The systems, methods, and devices disclosed herein provide a means for collecting high quality emissions testing data for smoking and/or vaping devices. The systems, methods, and devices disclosed herein operate at the same or better standards of data collection as existing testing devices. While existing testing devices require individual adaptor device iterations for each individual smoking/vaping device, the systems, methods, and devices disclosed herein offer a universal solution for a wide variety of smoking/vaping devices and their varied geometries.

In one aspect, a smoking machine adaptor is disclosed including a base, a resiliently deformable ferrule, and a cap. The base is configured to couple to a smoking machine and defines a central axis and a base input aperture. The resiliently deformable ferrule is sized to be received within the base input aperture and defines a ferrule aperture. The cap includes a cap flange sized to engage the ferrule and defining a cap aperture aligned with the ferrule aperture. The cap further includes a cap actuator coupled to the base and configured to move the cap flange relative to the base along the central axis between t a first position and a second position that is closer to the base than the first position. The ferrule aperture defines a first ferrule area in a plane perpendicular to the central axis when the cap flange is in the first position. The ferrule aperture defines a second ferrule area in the plane perpendicular to the central axis when the cap flange is in the second position, wherein the second ferrule area is less than the first ferrule area.

In some aspects, the techniques described herein relate to a smoking machine adaptor device including: a base configured to couple to a smoking machine, the base defining a central axis and a base cavity; a cap including a cap flange defining a cap aperture, and a cap actuator coupled to the base and configured to move the cap flange relative to the base along the central axis between a first position to a second position; and a resiliently deformable ferrule sized to be received within the base cavity and defining a ferrule aperture aligned axially with the cap aperture along the central axis, wherein the ferrule aperture defines a first ferrule area in a plane perpendicular to the central axis when the cap flange is in the first position, wherein the ferrule aperture defines a second ferrule area in the plane perpendicular to the central axis when the cap flange is in the second position, and wherein the second ferrule area is less than the first ferrule area.

In some aspects, the techniques described herein relate to a method of testing smoking products, the method including: coupling a base of a smoking machine adaptor device to a smoking machine so that the smoking machine receives fluid communication from the base; disposing a smoking product within a ferrule aperture of the smoking machine adaptor device; moving a cap of the smoking machine adaptor device from a first position a first axial distance from the base to a second position a second axial distance from the base; and compressing the ferrule as the cap moves from the first position to the second position such that the ferrule aperture decreases to sealingly engage the smoking product.

In some aspects, the techniques described herein relate to a smoking machine adaptor kit including: a base configured to couple to a smoking machine, the base defining a central axis and a base cavity; a cap including a cap flange defining a cap aperture, and a cap actuator coupled to the base and configured to move the cap flange relative to the base along the central axis between a first position to a second position; a first resiliently deformable ferrule sized to be received within the base cavity and defining a circular ferrule aperture configured to align axially with the cap aperture along the central axis, the circular ferrule aperture defining a first area when the cap is in the first position and a second, smaller area when the cap is in the second position; and a second resiliently deformable ferrule sized to be received within the base cavity and defining an oval ferrule aperture configured to align axially with the cap aperture along the central axis, the oval ferrule aperture defining a first area when the cap is in the first position and a second, smaller area when the cap is in the second position.

Additional advantages will be set forth in part in the description which follows or may be learned by practice. The advantages will be realized and attained by means of the elements and combinations particularly pointed out in the appended claims. It is to be understood that both the foregoing general description and the following detailed description are exemplary and explanatory only and are not restrictive, as claimed.

Figure 1:
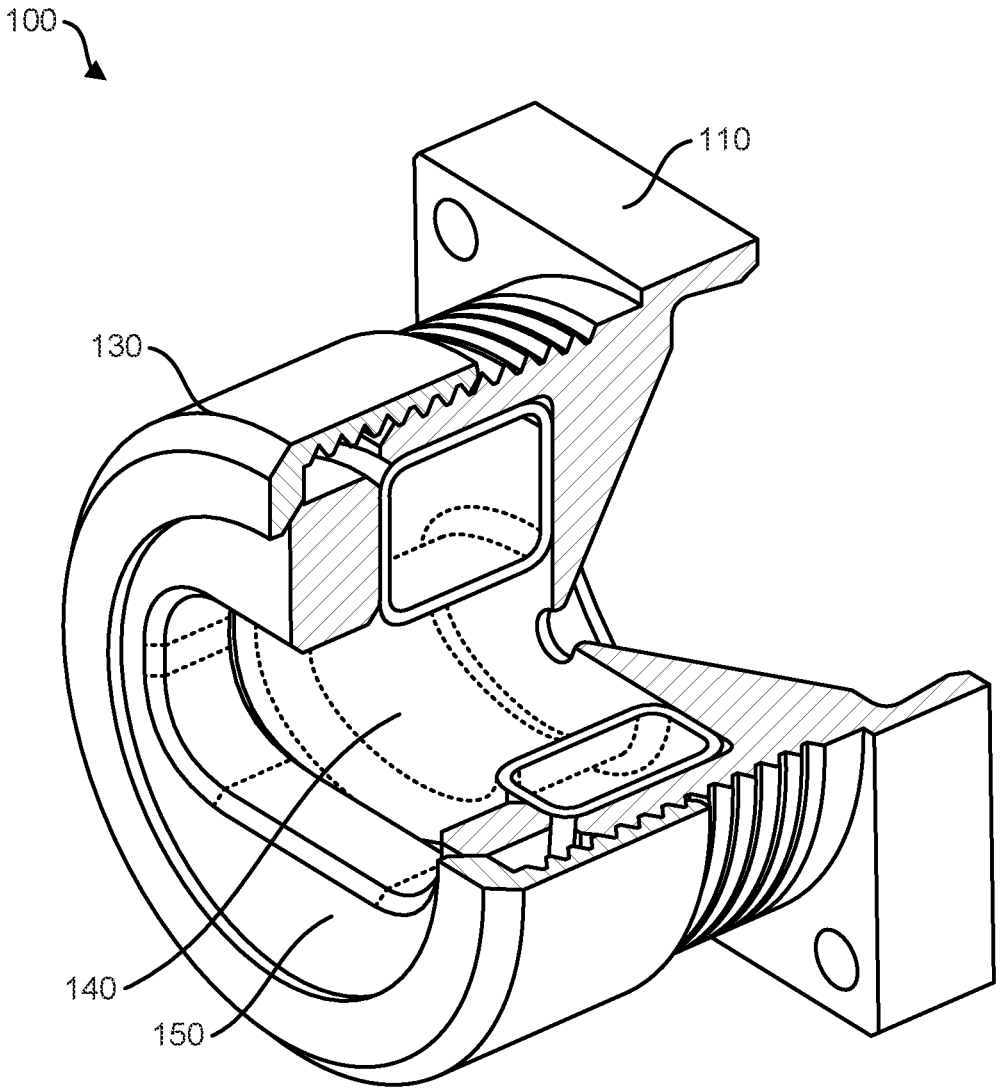
FIG. 1 is a perspective view of a universal adapter device, according to some implementations.

Various objects, aspects, features, and advantages of the disclosure will become more apparent and better understood by referring to the detailed description taken in conjunction with the accompanying drawings, in which like reference characters identify corresponding elements throughout. In the drawings, like reference numbers generally indicate identical, functionally similar, and/or structurally similar elements.

DETAILED DESCRIPTION

Referring generally to the figures, a smoking machine adaptor device is shown, according to various implementations.

The devices, systems, and methods disclosed herein provide for a universal smoking machine adaptor that interfaces with existing commercial smoking and vaping machines to enable emissions testing of cigars, cigarillos, e-cigarettes, and heated tobacco products. The devices, systems, and methods disclosed herein provide benefits including 1) the ability to seal with a much wider variety of tobacco products that have rigid and compressible mouthpieces, 2) an assembly with fewer parts that can be cleaned, assembled, and disassembled more quickly than typical cigar holders, 3) a stand-alone assembly that does not require an additional physical supporting mechanism for products weighing less than 250 g, 4) minimized dead volume within the device, 5) the ability to operate without the use of compressed air, 6) the ability to interface directly with typical smoking and vaping machines without interference, 7) the ability to interface directly to the back half of typical filter holders (e.g., 44 and 55 mm diameter filters), 8) an ergonomically optimized shape, 9) inhibit biasing (e.g., scavenging or contributing to) of nicotine and total particulate emissions coming from a mouth end of a tobacco product during machine smoking and vaping, and/or 10) the ability to seal with plastic-tipped mouth ends (e.g., on cigarillos), eliminating the need for removing the mouth end prior to testing, and/or 11) a benchmarked history of accuracy during testing with reference cigar, e-cigarette, cigarillo, cigarette, and heated tobacco products. Additionally, the devices, systems, and methods disclosed herein improve the accuracy, repeatability, reproducibility of data examined by FDA or other regulatory authorities to aid in tobacco product regulation, by industry for testing for compliance, and by academic and other institutions to further public health research.

Example Device #1

FIG. 1 shows a smoking machine adaptor device 100 that includes a base 110, a cap 130 threadable onto the base 110, a ferrule 140 received within the base 110, and a compression plate 150 captured by the cap 130 and shaped to selectively compress the ferrule 140. Generally, the base 110 is structured to engage a smoking and/or vaping machine. The ferrule 140 and compression plate 150 are shaped to receive a smoking product (e.g., a cigar, an electronic nicotine delivery system (ENDS), a cigarette, etc.), and the cap 130 is structured to compress the ferrule 140 to sealingly engage the smoking product during testing by the smoking machine. The device 100 provides a universal sealing architecture that radially deforms the ferrule 140 in response to axial compression imparted by the movement of the cap 130 relative to the base 110.

Figure 2:
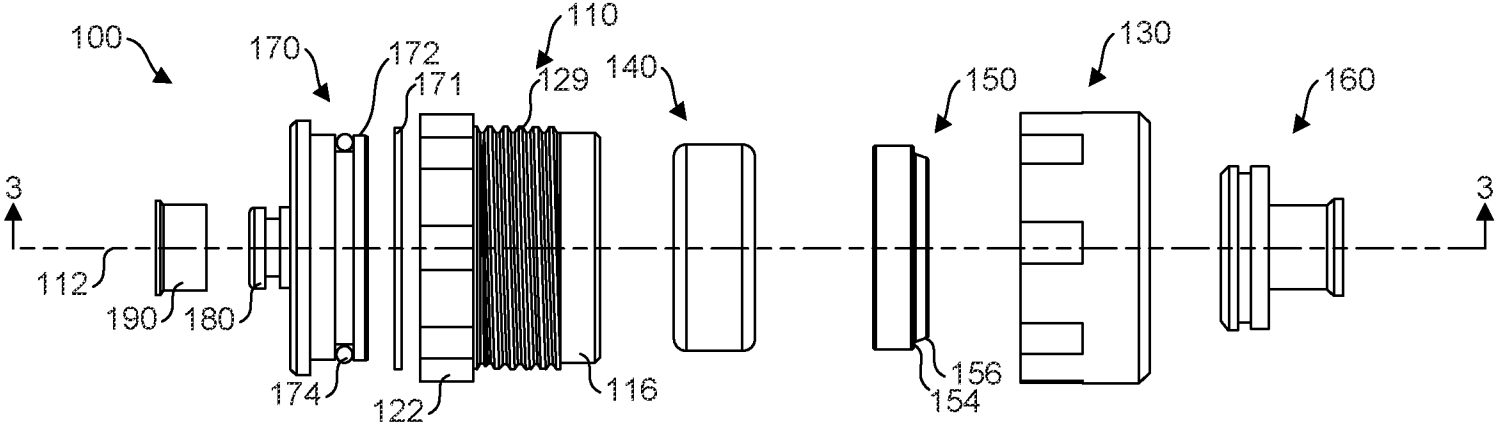
FIG. 2 is an exploded view of the universal adapter device of FIG. 1, according to some implementations.
Figure 3:
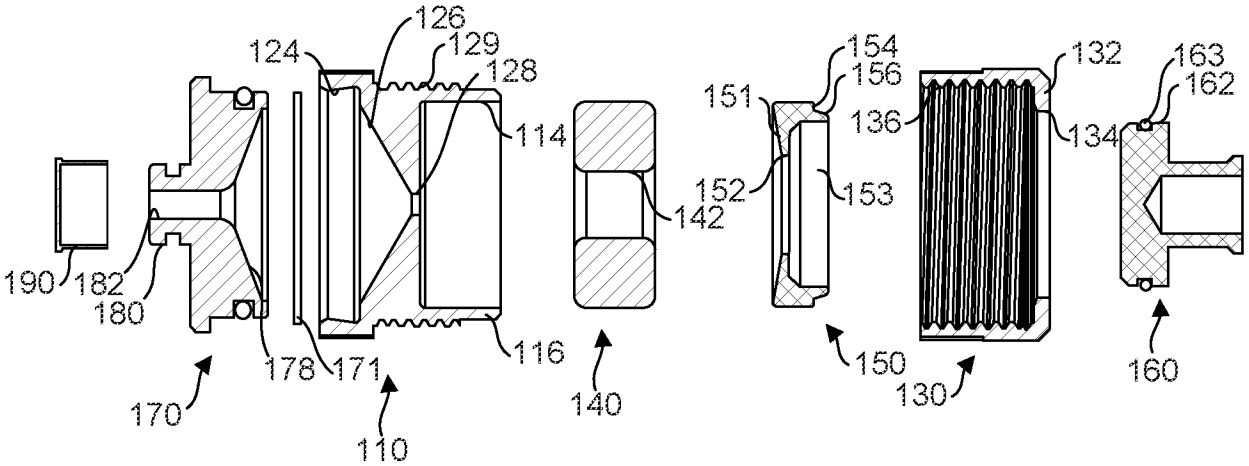
FIG. 3 is section view of the universal adapter device taken along line 3-3 of FIG. 2, according to some implementations.

As shown in FIGS. 2 and 3, of the device 100 also includes a dust cap 160 that can cover the cap 130 to inhibit the ingress of dust or other contaminates, and a filter holder 170 that is structured to hold a smoke filter 171 in place between the base 110 and the filter holder 170 and to couple the device 100 to the smoking machine. In some implementations, a filter cap 190 is included that can be removably attached to the filter holder 170 when the device 100 is not installed on the smoking machine to inhibit the intrusion of dust or other contaminates into the device 100. The components of the device 100 are generally assembled along a central axis 112.

The dust cap 160 includes a dust cap side wall 162 defining a seal recess sized to receive a dust seal 163. The dust cap 160 is sized to engage the compression plate 150 and inhibit the intrusion of dust and other particulates into the device 100 during storage. In some implementations, the dust cap 160 is structured to engage and seal the cap 130.

The filter holder 170 includes a filter holder connection surface 172 sized to engage with the base 110. A filter holder seal 174 (e.g., an oil resistant O-ring) is fitted within the filter holder connection surface 172 and engage the filter engagement side wall 122 to form a seal. In some implementations, a spring clip or other engagement mechanism may couple the filter holder 170 to the base 110. The filter holder 170 also defines a filter concentrating volume 178 (e.g., a conical volume of the filter holder). The filter concentrating volume 178 is sized to receive the filter 171. When engaged with the base 110, the filter 171 is disposed in between the base 110 and the filter holder 170. A filter holder output 180 is positioned opposite the filter 171 and sized to be received by a smoking and/or vaping machine. Aerosol and/or smoke travel from the nicotine product through the hole in the cap 130, the compression plate 150, the ferrule 140, and the base 110 to be collected onto the filter 171. Emissions not trapped by the filter 171 go through the filter holder output 180 and a an emissions output 182 which connects the filter concentrating volume 178 so that fluid (e.g., emissions not trapped by the filter 171) can move from the filter concentrating volume 178, through the smoke output 182, and into any analyzer (e.g., carbon monoxide analyzer) or gas trap device (e.g., an impinger) that is a part of the smoking machine.

The filter cap 190 is sized to seal the filter holder output 180 (e.g., before connecting the device 100 to a smoking and/or vaping machine, or after collecting a sample on the filter).

Figure 6:
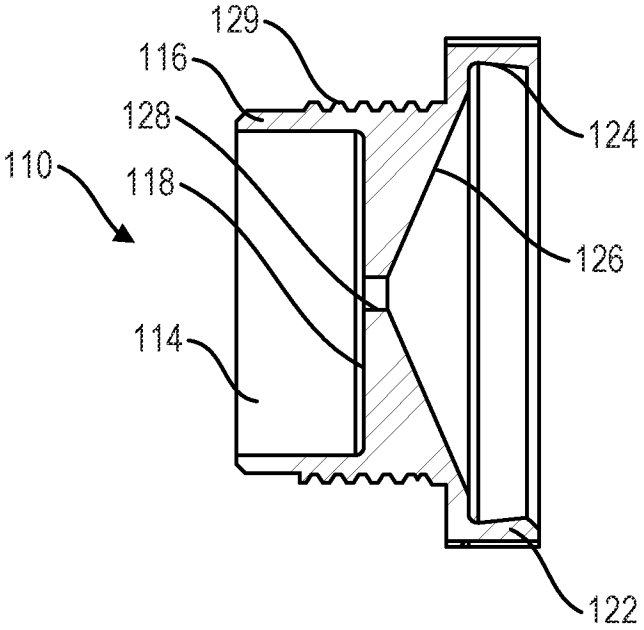
FIG. 6 is a section view of the base taken along line 6-6 of FIG. 4, according to some implementations.
Figure 4:
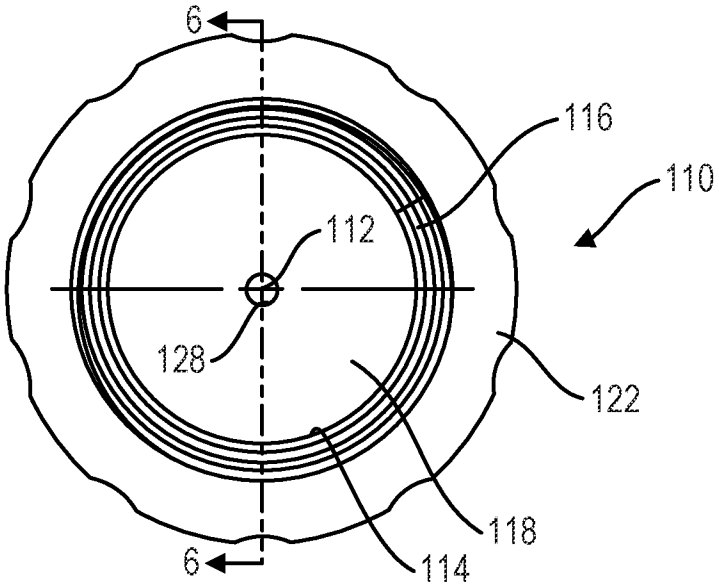
FIG. 4 is a top view of a base of the universal adapter device of FIG. 1, according to some implementations.
Figure 5:
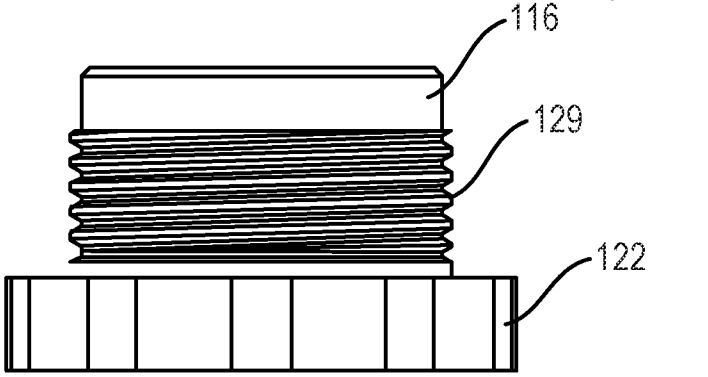
FIG. 5 is a front view of the base of FIG. 4, according to some implementations.
Figure 9:
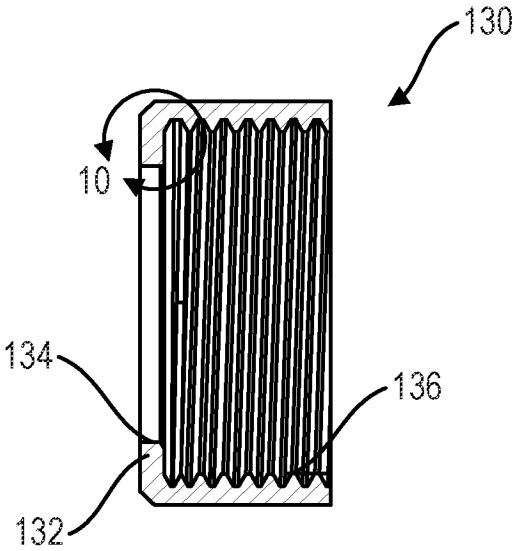
FIG. 9 is a is a section view of the cap taken along line 9-9 of FIG. 7, according to some implementations.
Figure 10:
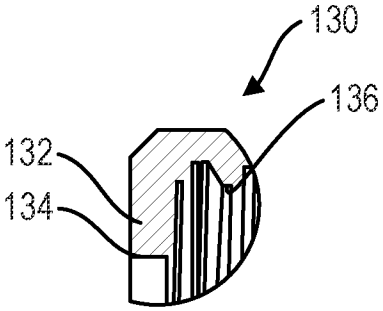
FIG. 10 is a detail view of the cap taken within line 10-10 of FIG. 9, according to some implementations.
Figure 7:
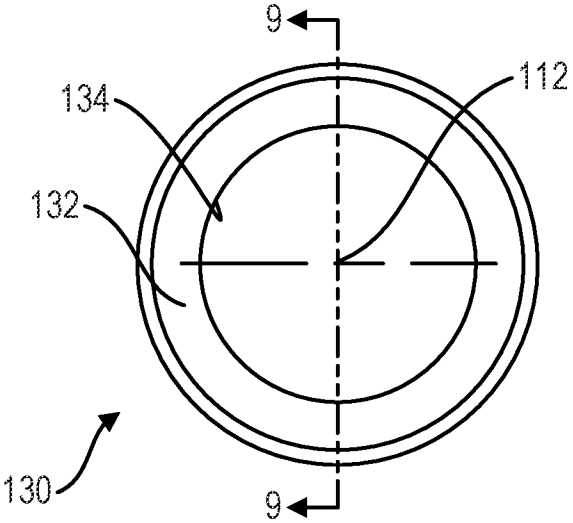
FIG. 7 is a top view of a cap of the universal adapter device of FIG. 1, according to some implementations.
Figure 8:
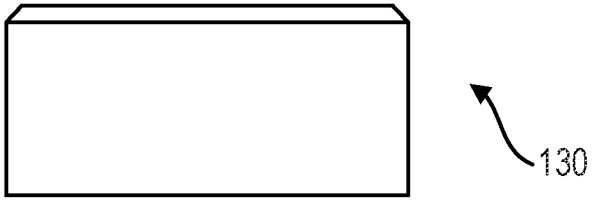
FIG. 8 is a front view of the cap of FIG. 7, according to some implementations.
Figure 13:
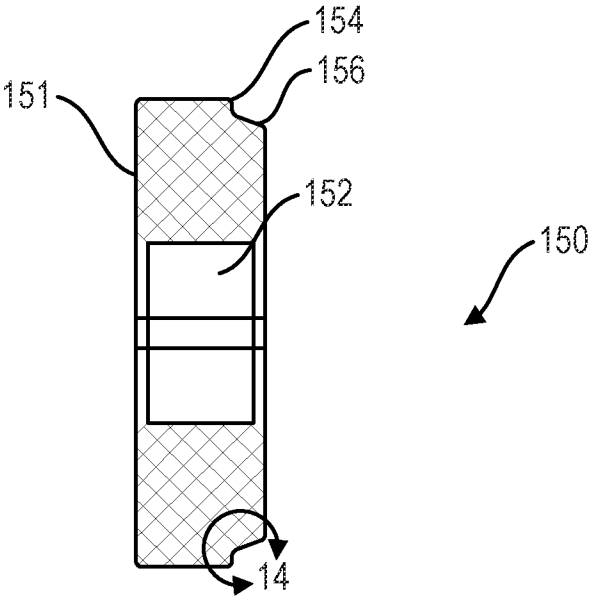
FIG. 13 is a section view of the compression plate taken along line 13-13 of FIG. 11, according to some implementations.
Figure 14:
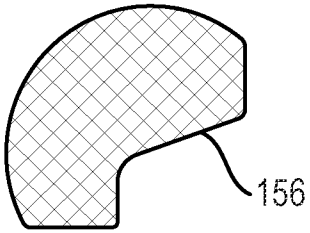
FIG. 14 is a detail view of the compression plate taken within line 14-14 of FIG. 13, according to some implementations.
Figure 11:
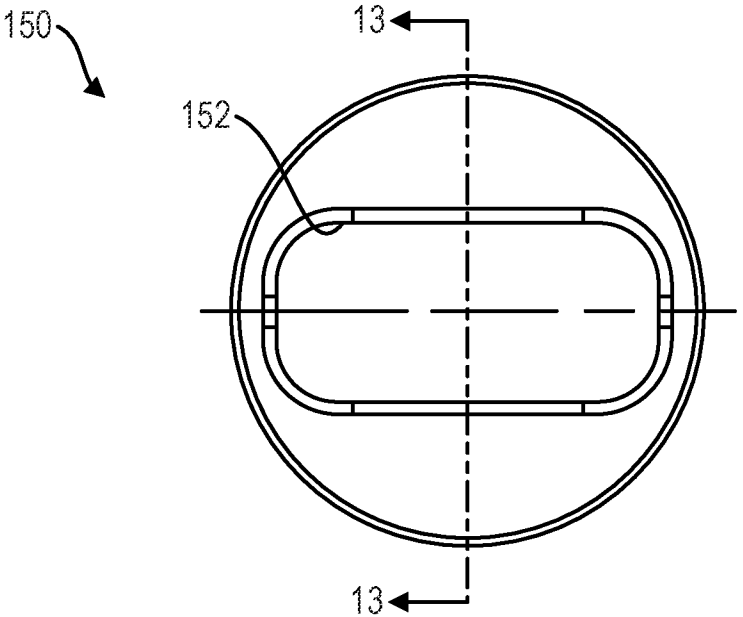
FIG. 11 is a top view of a compression plate of the universal adapter device of FIG. 1, according to some implementations.
Figure 12:
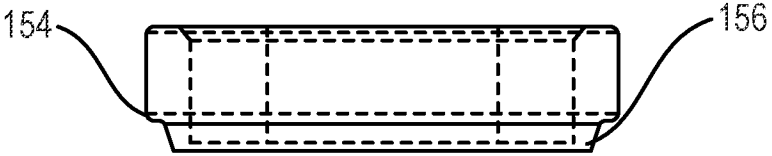
FIG. 12 is a front view of the compression plate of FIG. 11, according to some implementations.

As shown in FIGS. 4-6, the base 110 includes a radial side wall 116 that defines a base cavity 114 sized to receive the ferrule 140. In some implementations, the radial side wall 116 defines an interior diameter of about 1.5 cm to about 1.6 cm. The base cavity 114 is also bound by an inner floor 118. In some implementations, the base cavity 114 defines a ferrule cavity depth between the base cavity 114 and the inner floor 118 of about 0.6 cm to about 0.7 cm. The base 110 further includes a filter engagement side wall 122 that defines a filter cavity 124 sized to receive and hold the smoking filter smoke filter 171 (e.g., a standard Cambridge filter pad having a 55 mm diameter used for cigars/cigarillos or a 44 mm diameter used for e-cigarettes and cigarettes) and the filter holder 170. In some implementations, the filter engagement side wall 122 includes a tapered surface configured to accept or connect to a portion of the filter holder 170 such that the filter smoke filter 171 is held between the base 110 and the filter holder 170. The filter cavity 124 is further defined by a conical sidewall 126. A smoke passage 128 is defined between the inner floor 118 and the conical sidewall 126 to provide fluid transfer therebetween. The smoke passage 128 fluidically connects the base cavity 114 to the filter cavity 124. The conical sidewall 126 defines an expanding volume from the smoke passage 128 into the filter cavity 124. In some implementations, the conical sidewall 126 defines an angle relative to a plane perpendicular to the central axis 112 of between about 20 degrees and about 25 degrees. In some implementations, the conical sidewall 126 defines a pyramidal shape or another shape that provides and expanding volume.

The base 110 further includes a base actuator structure in the form of base threads 129 disposed on an outer surface of the base 110 adjacent to the radial side wall 116. In some implementations, the base actuator structure includes snap clips, a clamping system, machine screws through a base structure, a cam and cam follower, or another structure as desired.

In some implementations, the base 110 is sized to accept a 55 mm filter in the filter cavity 124. In some implementations, the base 110 defines an axial length along the central axis 112 of about 1.0 inch to about 2.0 inches. In some implementations, the axial length of the base is about 1.46 inches. In some implementations, a diameter of the smoke passage 128 is about 0.1 inches to about 0.3 inches. In some implementations, the diameter of the smoke passage 128 is about 0.2 inches. As shown, a diameter of the base cavity 114 is about 1.25 inches to about 1.75 inches. In some implementations, the diameter of the base cavity 114 is about 1.575 inches. In some implementations, a depth of the base cavity 114 along the central axis 112 is 0.5 inches to 0.75 inches. In some implementations, the depth of the base cavity 114 is about 0.617 inches. In some implementations, the base 110 is sized to accept a standard 44 mm filter in the filter cavity 124 and the other base elements are correspondingly smaller in size (e.g., a 0.157 inch diameter smoke passage).

As shown in FIGS. 7-10, the cap 130 includes a cap flange 132 defining a cap aperture 134. The cap flange 132 is shaped to abut and engage with the compression plate 150. The cap aperture 134 is larger than the ferrule aperture 142 or the plate aperture 152 such that when the device 100 is assembled, the cap aperture 134 does not occlude the ferrule aperture 142 or the plate aperture 152. In some implementations, the cap flange 132 defines a chamfer or sloped relief adjacent the cap aperture 134 that improves centering of the plate aperture 152 and/or the ferrule aperture 142 within the cap aperture 134.

A cap actuator structure in the form of cap threads 136 is disposed on an inner surface of the cap 130. The cap 130 is sized to engage with the base 110 such that the cap threads 136 engage the base threads 129 so that the cap 130 is movable relative to the base 110 via the cap threads 136 and the base threads 129 of the actuator structures along the central axis 112.

In some implementations, the cap aperture 134 defines a diameter of about 1.0 inch to about 1.5 inches. In some implementations, the diameter of the cap aperture 134 is about 1.27 inches. In some implementations, an outer diameter of the cap 130 is about 1.75 inches to about 2.25 inches. In some implementations, the outer diameter of the cap 130 is about 2.07 inches. In some implementations, the cap 130 defines an axial length along the central axis 112 of about 0.75 inches to about 1.25 inches. In some implementations, the axial length of the cap 130 is about 0.98 inches.

As shown in FIGS. 11-14, the compression plate 150 includes a compression surface 151 shaped to engage the ferrule 140 and a plate shoulder 154 and a taper 156 shaped to engage with the cap flange 132 and cap aperture 134 of the cap 130. The plate shoulder 154 and the taper 156 cooperate with the cap flange 132 to center the compression plate 150 about the central axis 112 when the device 100 is assembled and to maintain the compression plate 150 in a plane perpendicular to the central axis 112. The compression plate 150 defines a plate aperture 152 having a plate profile corresponding to a smoking device profile of the ferrule 140. For example, the plate aperture 152 defines a rounded rectangular shape that can be used with a generally rectangular shaped smoking device. In some implementations, the plate aperture 152 includes a round over or chamfer to reduce sharp edges and inhibit snagging or scratching smoking devices during use. The compression plate 150 further defines a compression plate dust cap aperture or recess 153 that is sized to sealingly receive the dust cap 160 to inhibit the intrusion of dust during storage.

Figure 17:
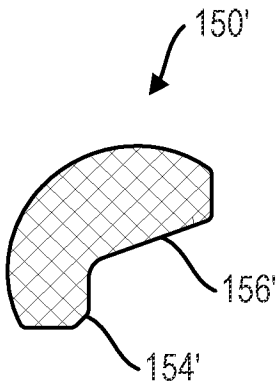
FIG. 17 is a detail view of the compression plate taken within line 17-17 of FIG. 16, according to some implementations.
Figure 16:
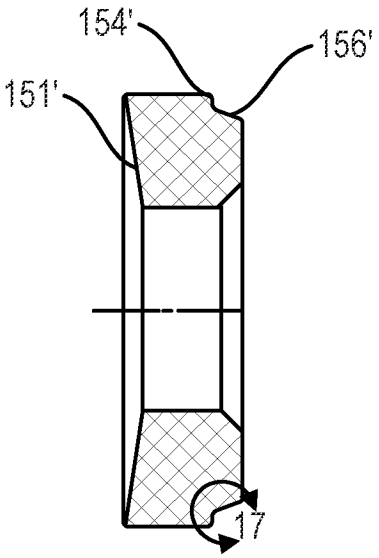
FIG. 16 is a section view of the compression plate taken along line 16-16 of FIG. 15, according to some implementations.
Figure 15:
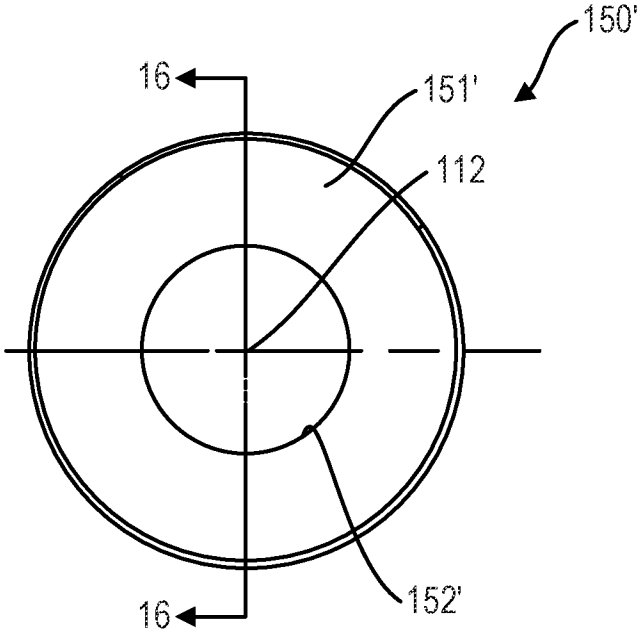
FIG. 15 is a top view of another compression plate, according to some implementations.

As shown in FIGS. 15-17, another compression plate 150' also defines a compression plate dust cap aperture or recess 153 that is sized to sealingly receive the dust cap 160 to inhibit the intrusion of dust during storage. The compression plate 150' includes a compression surface 151' shaped to engage the ferrule 140 and a plate shoulder 154' and a taper 156' shaped to engage with the cap flange 132 and cap aperture 134 of the cap 130. The compression surface 151' includes a generally frustoconical shape. In some implementations, the compression surface 151' includes a shape that biases deformation of the ferrule 140 toward the central axis 112 when the compression plate 150' is moved along the central axis 112 to compress the ferrule 140 against the inner floor 118 of the base 110. The plate shoulder 154' and the taper 156' cooperate with the cap flange 132 to center the compression plate 150' about the central axis 112 when the device 100 is assembled and to maintain the compression plate 150' in a plane perpendicular to the central axis 112. The compression plate 150' defines a plate aperture 152' having a plate profile corresponding to a smoking device profile of the ferrule 140. For example, the plate aperture 152' defines a circular shape that can be used with a generally round shaped smoking device (e.g., a cigar). In some implementations, the plate aperture 152' includes a round over or chamfer to reduce sharp edges and inhibit snagging or scratching smoking devices during use. In other implementations, the compression plate may define differently shaped apertures and profiles depending on the intended smoking device for use with the device 100 (e.g., an oval ferrule aperture, a rectangle plate profile).

Figure 20:
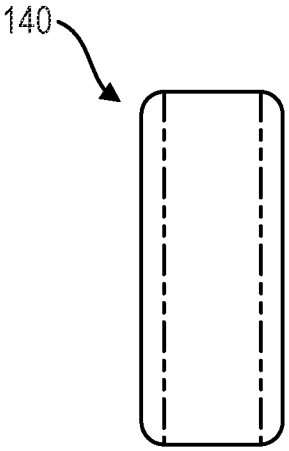
FIG. 20 is a front view of the ferrule of FIG. 18, according to some implementations.
Figure 18:
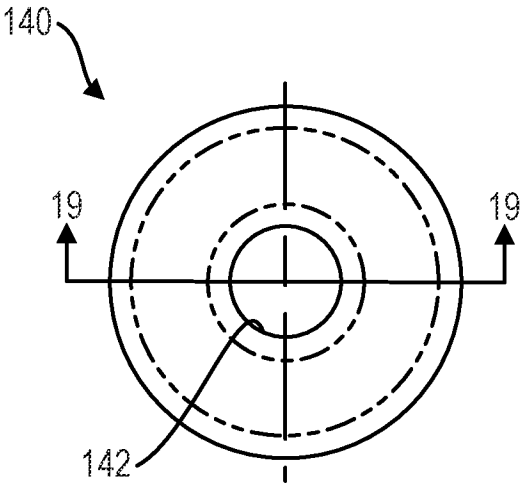
FIG. 18 is a top view of a ferrule of the universal adapter device of FIG. 1, according to some implementations.
Figure 19:
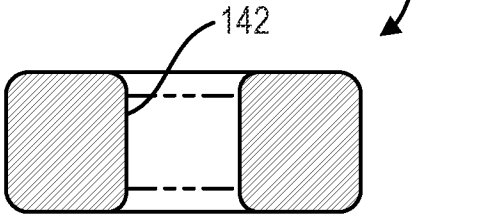
FIG. 19 is a section view of the ferrule taken along line 19-19 of FIG. 18, according to some implementations.

As shown in FIGS. 18-20, the ferrule 140 includes a resiliently deformable body sized to be received within the base cavity 114 of the base 110 and compressed by the compression plate 150. In some implementations, the ferrule 140 is formed from a flexible, chemically inert material that holds its shape and can be compressed with a force. Once that force is released, the ferrule 140 returns to its original shape and is reusable. The ferrule 140 includes an outer surface having a ferrule outer diameter perpendicular to the central axis 112 is sized to be received within the diameter of the base cavity 114. In some implementations, the ferrule outer diameter is about 1.25 inches to about 1.75 inches. In some implementations, the ferrule outer diameter is about 1.575 inches. The ferrule 140 also defines a ferrule width parallel to the central axis 112. In some implementations, the ferrule width is about 0.5 inches to about 0.75 inches. In some implementations, the ferrule width is about 0.625 inches. The ferrule width is sized so that movement of the actuation structures (e.g., the base threads 129 and the cap threads 136) move the compression plate 150 into engagement with the ferrule 140 and axially compress the ferrule 140 and cause radially deformation of the ferrule 140 toward the central axis 112.

Figure 21:
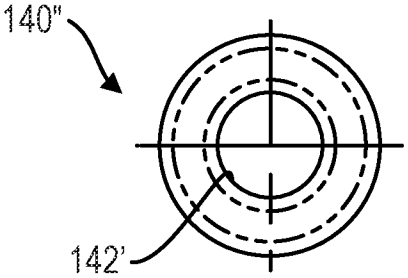
FIG. 21 is a top view of another ferrule of the universal adapter device of FIG. 1, according to some implementations.
Figure 22:
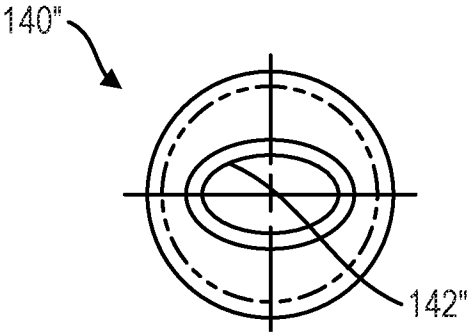
FIG. 22 is a top view of another ferrule of the universal adapter device of FIG. 1, according to some implementations.
Figure 23:
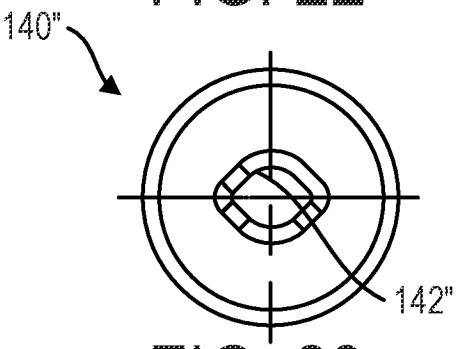
FIG. 23 is a top view of another ferrule of the universal adapter device of FIG. 1, according to some implementations.

The ferrule 140 defines a ferrule aperture 142 having a smoking device profile. The ferrule aperture 142 may include a variety of shapes. For example, the ferrule 140 shown in FIGS. 18-20 includes a ferrule aperture 142 having a small circle smoking device profile. As shown in FIG. 21, a ferrule 140' includes a large round circle shaped ferrule aperture 142'. As shown in FIG. 22, a ferrule 140" includes a large ellipse shaped ferrule aperture 142". As shown in FIG. 23, a ferrule 140''' includes a small ellipse shaped ferrule aperture 142'''. In some implementations, the ferrule 140 can include a ferrule aperture 142 defining any other shaped profile made to accommodate a smoking device profile (e.g., an oval shape, a octagonal shape, a square shape, etc.). The ferrule aperture 142 defines a first ferrule area in a plane perpendicular to the central axis 112. When deformed and/or axially compressed, the ferrule aperture 142 defines a second ferrule area in the plane perpendicular to the central axis 112 such that the second ferrule area is less than the first ferrule area. The inner and outer edges of the ferrule aperture 142 may be chamfered, rounded-over, or a sharp edge to aid insertion of a smoking device during use.

The ferrule aperture 142 is sized and shaped to accept a smoking device therein. For example, the smoking device profile of a cigar may be circular such that the ferrule aperture is also circular with a diameter sufficient for the cigar to be inserted therein. By compressing the ferrule 140 in the device 100, a leak-proof seal is formed around the smoking device (e.g., cigar).

Figure 24:
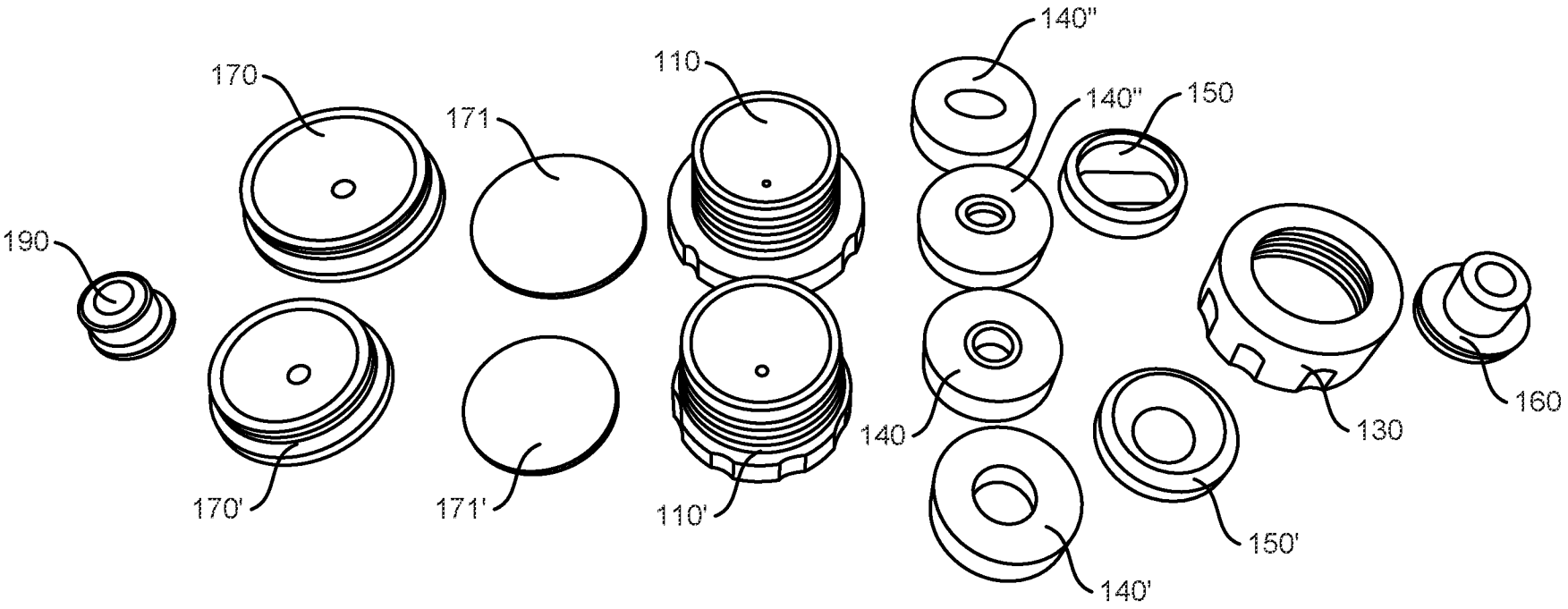
FIG. 24 is a perspective view of a universal adapter kit including the universal adapter device of FIG. 1, according to some implementations.
Figure 25:
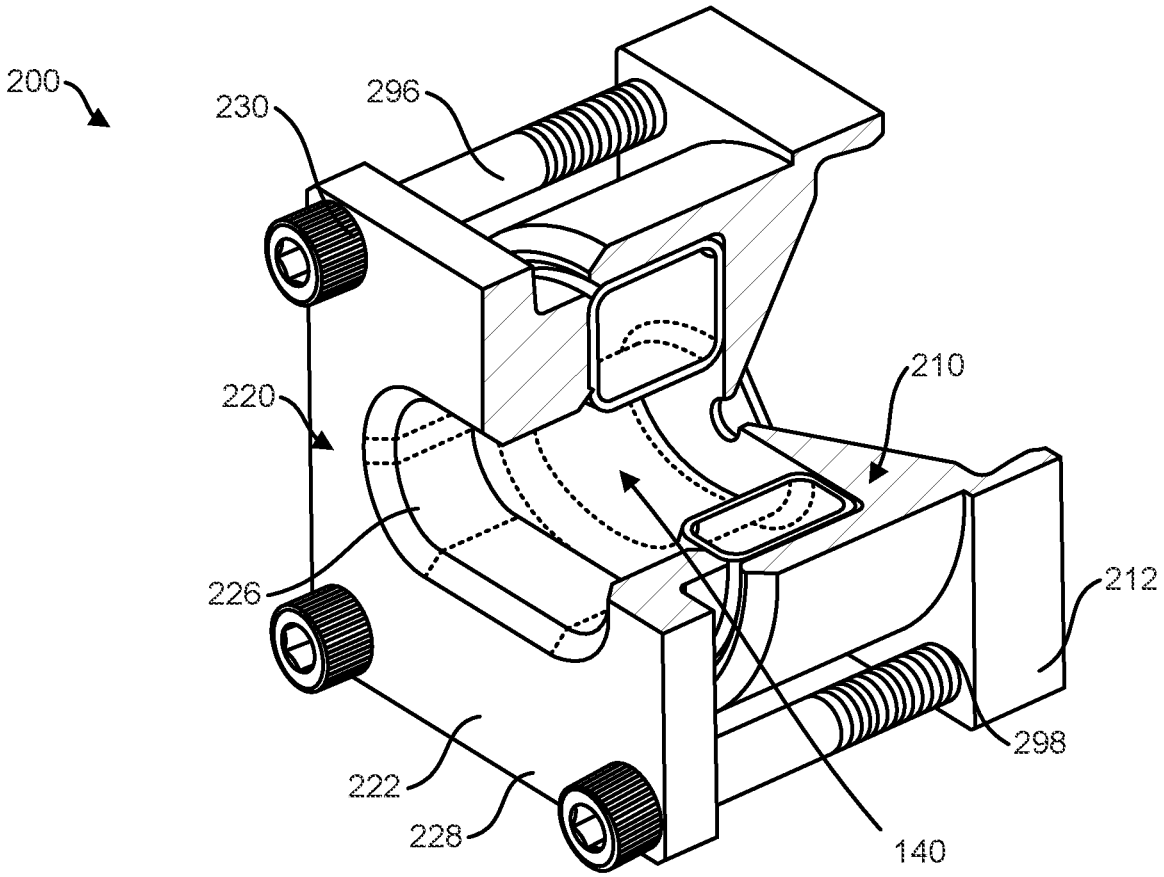
FIG. 25 is a perspective view of another universal adapter device, according to some implementations.
Figure 26:
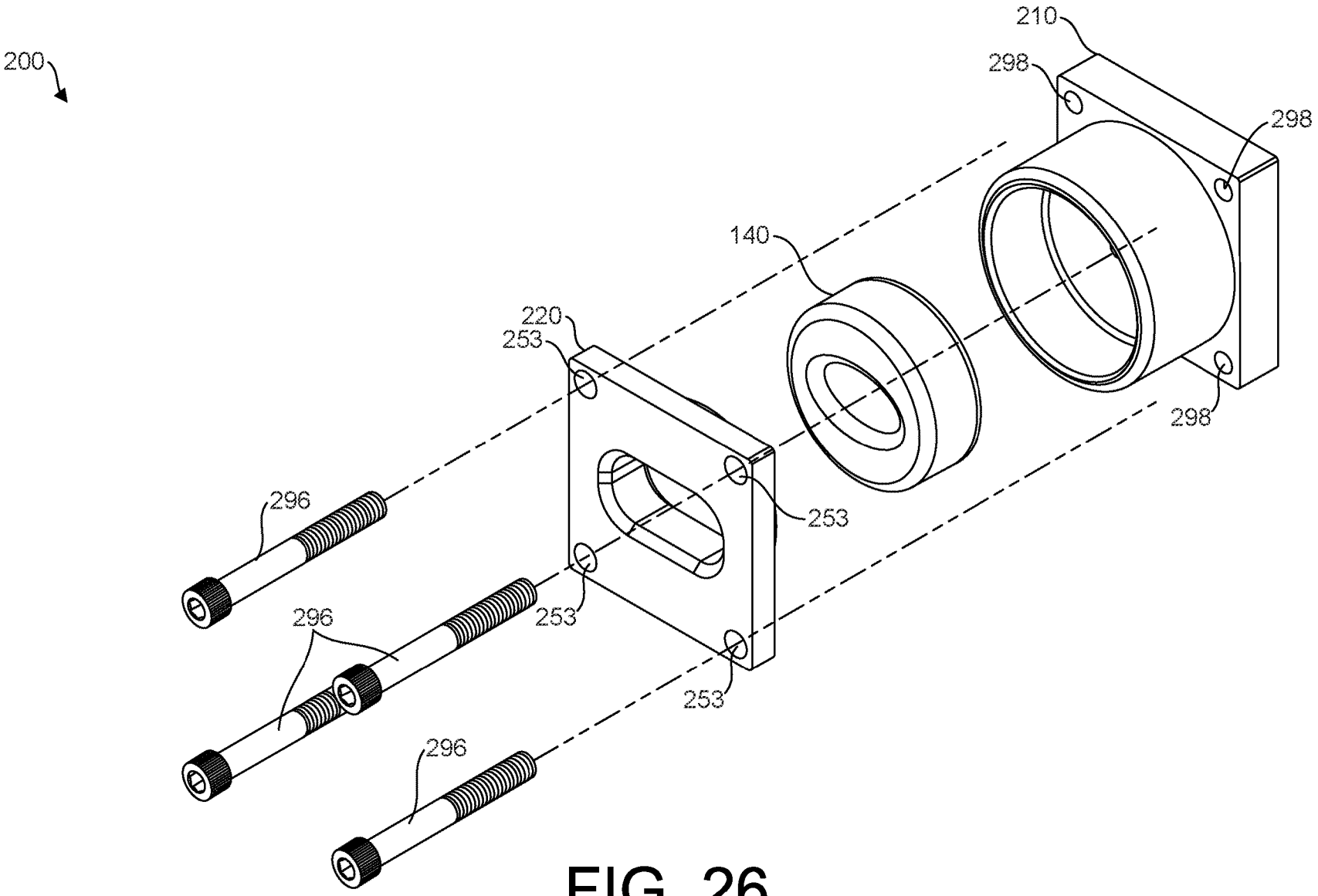
FIG. 26 is an exploded view of the universal adapter device of FIG. 25, according to some implementations.
Figure 28:
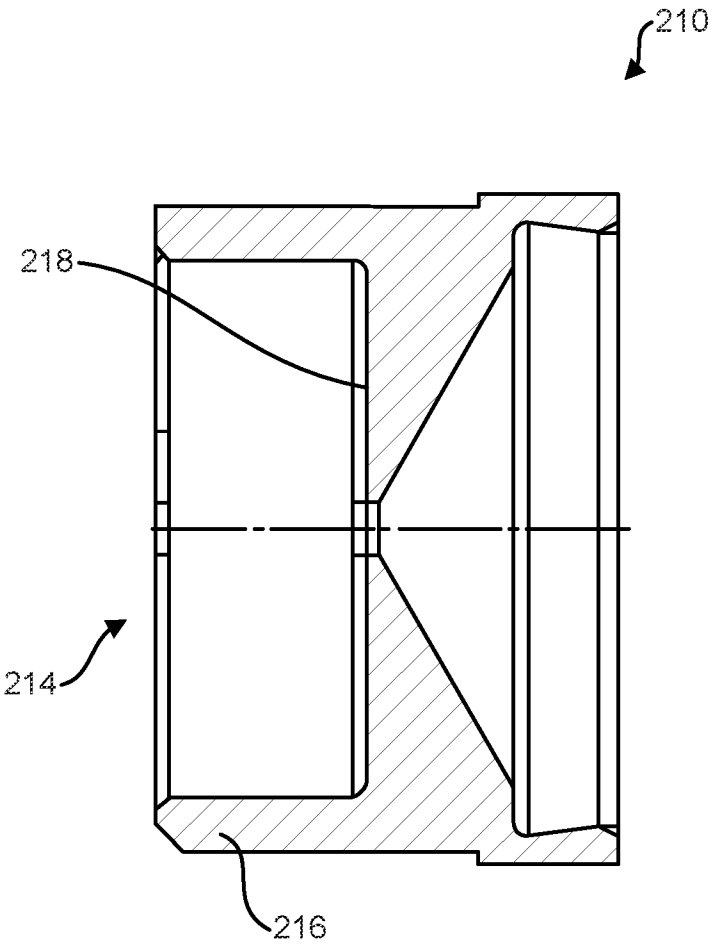
FIG. 28 is a section view of the base taken along line 28-28 of FIG. 27, according to some implementations.
Figure 27:
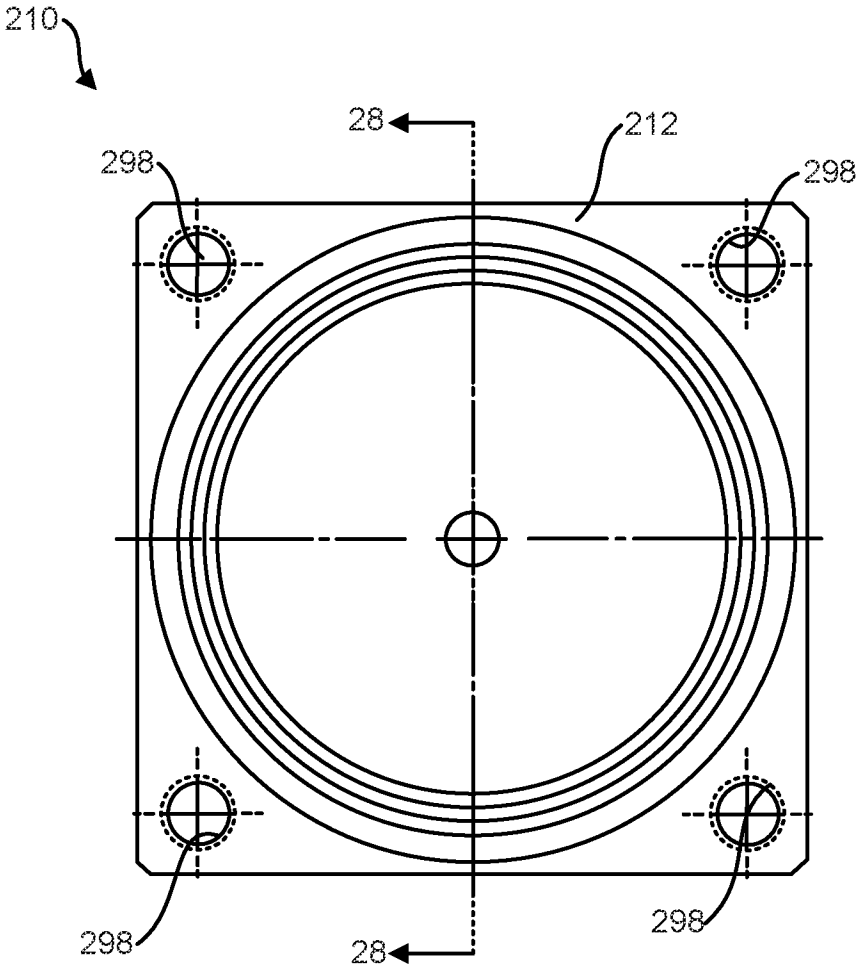
FIG. 27 is a top view of a base of the universal adapter device of FIG. 25, according to some implementations.
Figure 30:
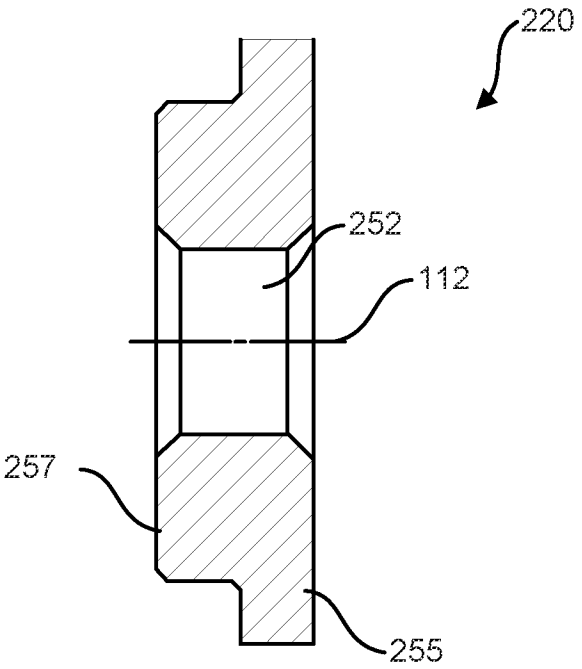
FIG. 30 is a section view of the compression plate taken along line 30-30 of FIG. 29, according to some implementations.
Figure 29:
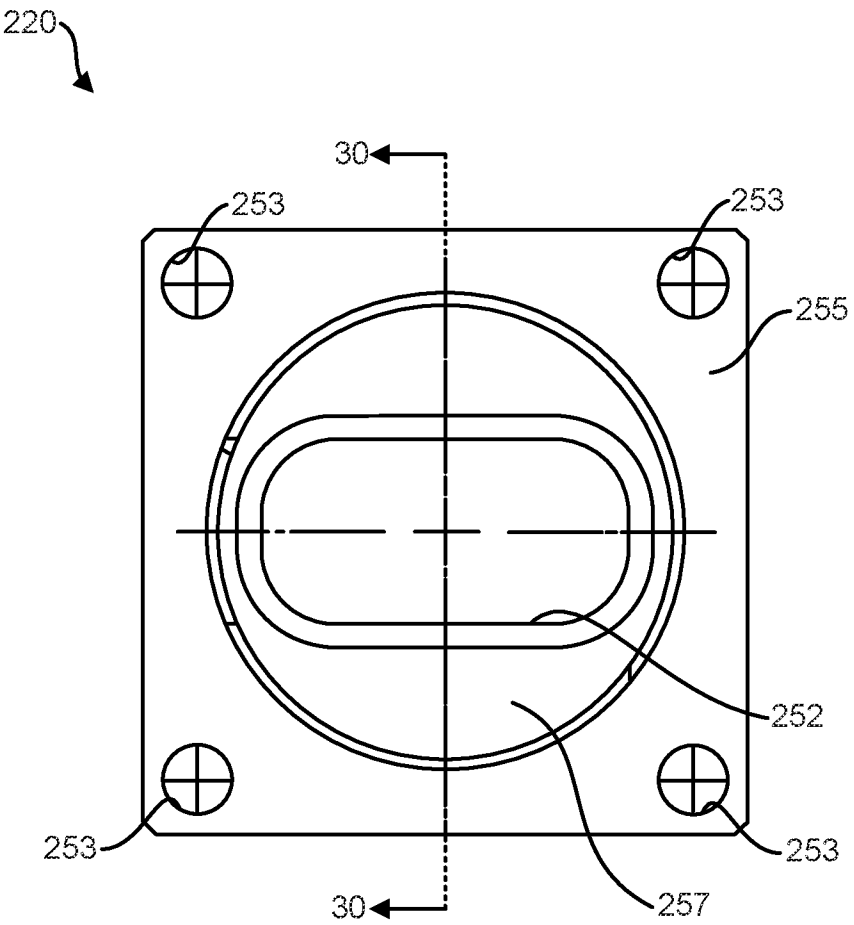
FIG. 29 is a top view of a compression plate of the universal adapter device of FIG. 25, according to some implementations.

As shown in FIG. 24, a universal coupler kit 194 includes the base 110, the compression plate 150, the compression plate 150', the cap 130, the filter holder 170, and the filter 171. The universal coupler kit 194 also includes the ferrule 140, the ferrule 140', the ferrule 140", and the ferrule 140'''. The universal coupler kit 194 also includes an alternative base 110' sized to hold a different sized filter 171, and an alternative filter holder 170' sized to engage the alternative base 110'. The components of the universal coupler kit 194 can be used together to provide an arrangement suited to test a large variety of smoking and vaping devices (e.g., vaping pens, cigars, cigarettes, etc.). In some implementations, the rigid components (e.g., the base, the filter holder, etc.) are formed from ultrahigh molecular weight polyethylene (UHMW-P). In some implementations the ferrules are color coded for easy identification and differentiation. For example the ferrule 140 is blue, the ferrule 140' is red, the ferrule 140" is yellow, and the ferrule 140'''' is green.

In operation, the ferrule 140 and compression plate 150 are selected based on the smoking device to be tested (i.e., the shape of the ferrule aperture 142 corresponds to the profile of the smoking device to be tested). The ferrule 140 is placed within the base cavity 114 of the base 110, and the compression plate 150 is placed within the cap 130 such that the cap flange 132 aligns with the plate shoulder surface 154 and the taper 156 of the compression plate 150.

The cap 130 and the base 110 are then coupled together via the cap threads 136 and the base threads 129. The filter 171 is placed within the filter cavity 124 of the base 110, and the filter holder 170 is coupled to the base 110, enclosing the filter 171 between the base 110 and the filter holder 170. The filter cap 190 is removed. The dust cap 160 is optionally disposed around the cap 130 or inside the compression plate 150 or 150'. The assembled device 100 can then be attached to a smoking machine for collecting emissions from the smoking device attached to the device 100.

The device 100 defines a loose configuration wherein the ferrule aperture 142 defines a first ferrule area in a plane perpendicular to the central axis 112. In the loose configuration, the distance between the compression surface 151 of the compression plate 150 and the inner floor 118 of the base 110 is such that ferrule 140 is not (or is minimally) compressed. That is, in the loose configuration, the cap 130 is in a first position wherein the distance between the flat side of the compression plate 150 and the inner floor 118 is the same as or substantially similar to each of the thickness of the ferrule 140 and the ferrule cavity depth.

To move from the loose configuration to a tightened configuration, the actuation structure is actuated so that the cap 130 and the compression plate 150 are moved closer to the base 110. The cap 130 is twisted along the cap threads 136 which are engaged with the base threads 129 to move the cap 130 and the compression plate 150 axially towards the base 110 until the cap 130 is in a second position. As the distance between the compression surface 151 of the compression plate 150 and the inner floor 118 decreases, the ferrule 140 is squeezed such that the ferrule 140 is deformed. The axial compression of the ferrule 140 along the central axis 112 results in radial deformation of the ferrule aperture 142 inward toward the central axis 112.

In the tightened configuration, the ferrule aperture 142 defines a second ferrule area in a plane perpendicular to the central axis 112. The second ferrule area is smaller than the first ferrule area due to the deformation of the ferrule 140 in the base cavity 114. Thus, in the tightened configuration, the ferrule 140 squeezes the smoking device within the ferrule aperture 142, creating a firm, leak-free seal on the smoking device for the duration of the test.

Therefore, by twisting the cap 130 relative to the base 110, a variety of smoking and vaping devices may be held and scaled within the device 100.

As the test is performed, vapor from the smoking device enters the base 110 and moves through the smoke passage 128, into the filter cavity 124, and through the filter 171 disposed therein. The filter 171 traps and collects particles and aerosol (e.g., total particulate matter (TPM) and/or total aerosol matter (TAM)) for testing. Emissions not trapped by the filter 171 proceed through the filter concentrating volume 178 of the filter holder 170 and out of the device 100 through the output 182. The emissions may proceed into the smoking testing machine for analysis or capture.

Example Device #2

FIGS. 25-30 show a smoking machine adaptor device 200 according to another implementation. The device 200 is similar to the device 100 and includes like components numbers similarly to the device 100 discussed above in the 200 series of reference numbers. The device 200 includes a set of machine screws 296 to move the cap 230 and base 210 together to compress the ferrule 140.

The device 200 includes a base 210, the ferrule 140, a compression plate 220, and four machine screws 240. In other implementations, a different number of screws may be used (e.g., 1, 2, 3, 5, 6, 7, 8, 9, 10, or more).

The base 210 is substantially similar to the base 110 of device 100 and includes a square base 212 with four screw holes 214 therethrough. The base 210 further includes a ferrule aperture, a radial side wall, and an inner floor. The filter side of the base 210 is also similar to the base 110 of device 100.

The compression plate 220 defines a plate opening 252 that functions similar to the plate aperture 152 of the compression plate 150 discussed above. A square base 255 of the compression plate 220 includes four screw holes 253 corresponding to the four screw holes 298 of the base 210. A compression surface 257 fits within the ferrule aperture 214 an of the base 210.

In use, the ferrule 140 is placed within the ferrule aperture 214 of the base 210. The compression plate 220 is then placed adjacent to the base 210 with the compression surface 232 abutting a surface of the ferrule 140. The four machine screws 296 are threaded through the four holes 253 of the compression plate 220 and into the four threaded holes 298 of the base 210.

To move from the first configuration (wherein the ferrule aperture 142 defines a first ferrule area in a plane perpendicular to the central axis 112) to the second configuration (wherein the ferrule aperture 142 defines a second ferrule area in a plane perpendicular to the central axis 112), each of the four screws 296 are tightened. Tightening of the screws 296 moves the compression plate 220 from a first position to a second position. In the second position, the compression plate 220 is closer to the base plate 210 than in the first position. Movement of the compression plate 220 causes the compression surface 257 to move further into the ferrule aperture 214, compressing and deforming the ferrule 140.

Experimental Testing and Setup

Figure 31:
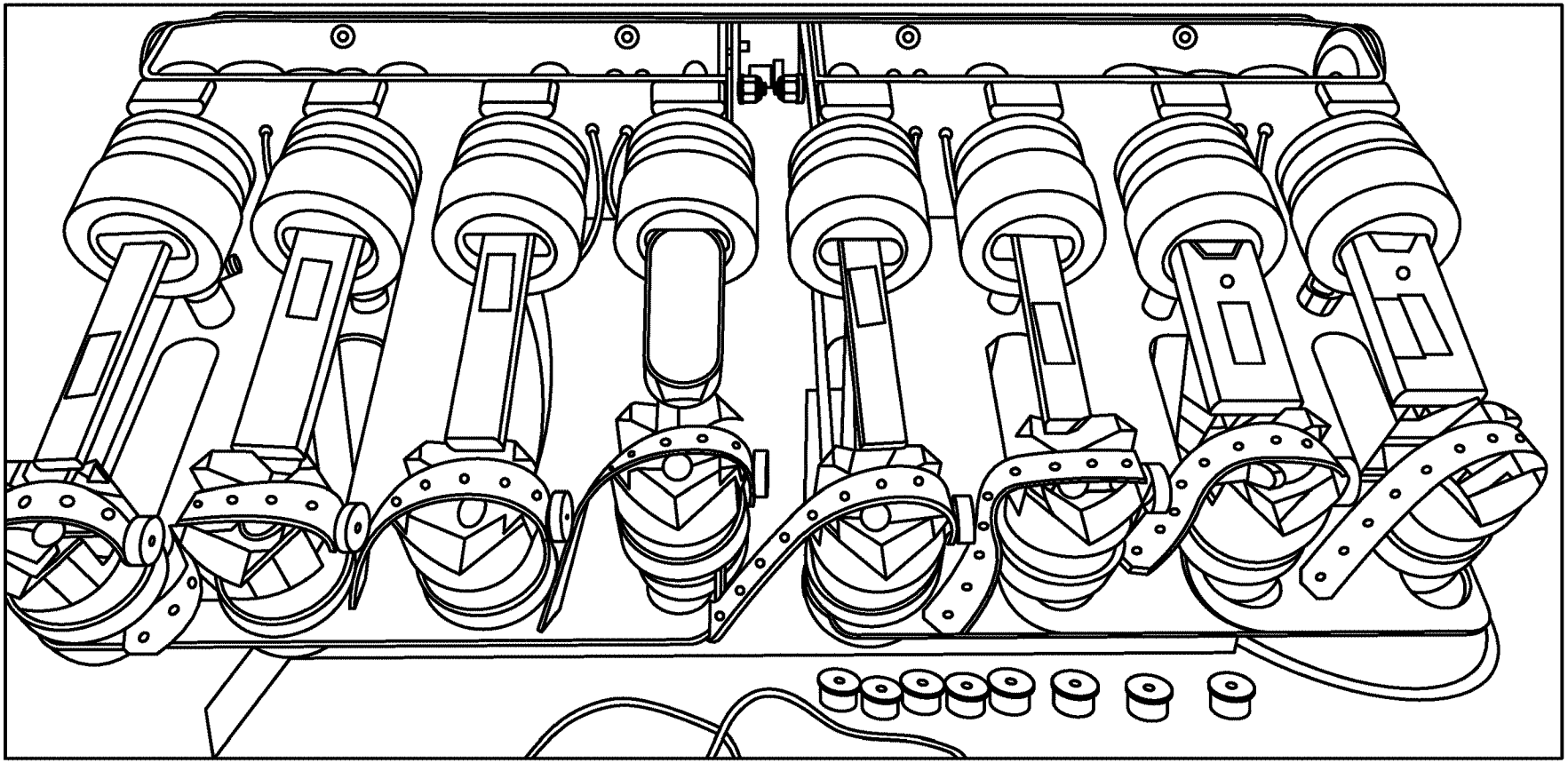
FIG. 31 is a perspective view of eight universal adapter devices installed on a vaping machine, according to some implementations.

As shown in FIG. 31, a standard vaping testing machine, the CETI-8 machine, measuring emissions from commercial electronic nicotine delivery systems (ENDS) using the universal smoking machine adaptor of this disclosure (e.g., the device 100 shown in FIG. 1). The filter caps are shown in the bottom of the image, removed during the testing operation.

Rather than rely on individual adaptors for each electronic nicotine delivery device, the universal adaptor of this disclosure accommodates the geometry and profile of a variety of electronic nicotine delivery devices. Thus, the CETI-8 machine may operate with a set of universal smoking machine adaptors (e.g., a set of devices 100) rather than requiring a suite of adaptor options to accommodate each existing device. Furthermore, while the existing adaptors may not accommodate novel electronic nicotine delivery devices that enter the market, the universal adaptor of this disclosure can accommodate devices not yet on the market. The result of the universal smoking machine adaptors is a streamlined, robust, and repeatable solution for testing emission properties of various nicotine devices and products.

Figure 34:
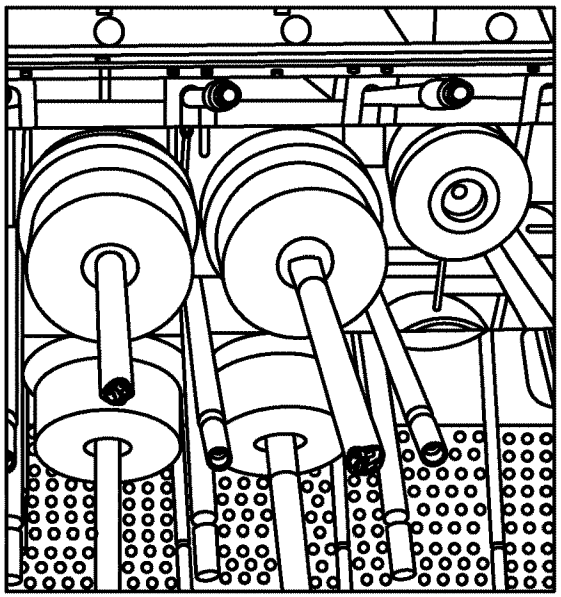
FIG. 34 is a perspective view of two universal adapter devices of FIG. 1 installed on a smoking machine with a third combustible product and a fourth combustible product, according to some implementations.
Figure 33:
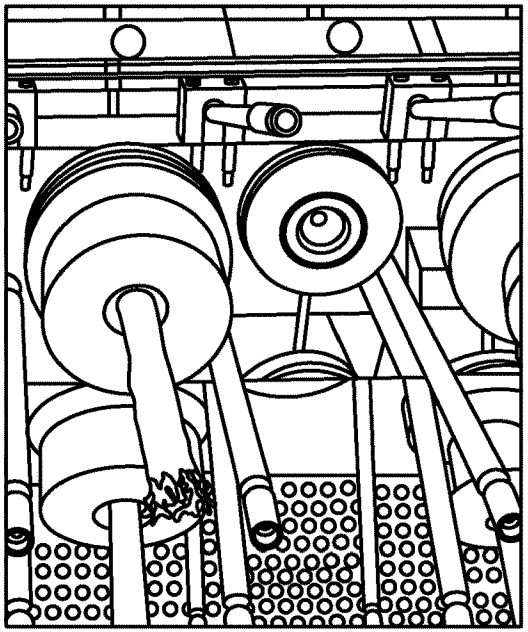
FIG. 33 is a perspective view of the universal adapter device of FIG. 1 installed on a smoking machine with a second combustible product, according to some implementations.
Figure 32:
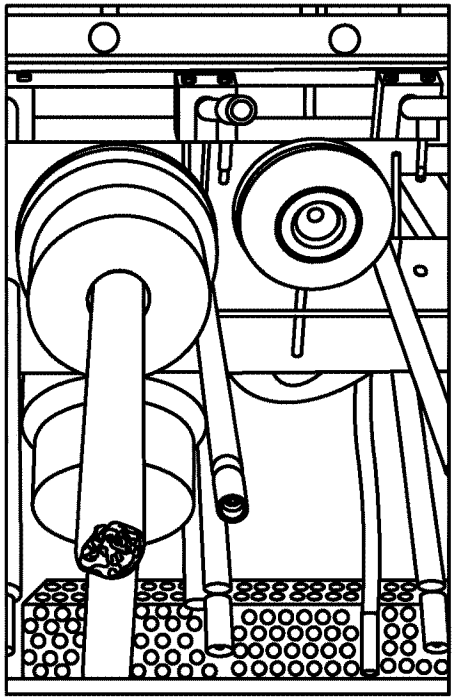
FIG. 32 is a perspective view of the universal adapter device of FIG. 1 installed on a smoking machine with a first combustible product, according to some implementations.

FIGS. 32-34 show a cigar-smoking machine for testing the emissions from cigars and cigarillos (SM450-CV, Cerulean) equipped with the universal smoking machine adaptor of this disclosure (e.g., the device 100).

The universal adaptor device 100, 200 of this disclosure accommodates the geometry and profile of a variety of cigars and cigarillos. Thus, the SM450-CV testing device, and similar devices, may operate with a set of universal smoking machine adaptors (e.g., the device 100, 200) rather than requiring a suite of options to accommodate each different smoking device. Furthermore, the universal adaptor device 100, 200 of this disclosure accommodates both electronic nicotine delivery devices and cigars/cigarillos, as well as a variety of other devices (e.g., heated tobacco devices). Therefore, the universal adaptor device 100, 200 of this disclosure provides a significant improvement over existing devices.

A series of experiments and validation tests were conducted to evaluate the systems, methods, and devices of this disclosure (e.g., by examining leak rate). In one example test, leak rate testing showed vacuum changes of less than 2% over the two-minute period for the USMA sealing to different tobacco products with a wide variety of mouth ends. Experimental devices of varied embodiments were tested and evaluated alongside existing smoking machine adaptor devices (e.g., the CDC's adapter specifically designed for JUUL products). The results showed that the universal adapter devices of this disclosure met or exceeded the performance of existing devices. The results prove that the universal adapter devices of this disclosure can maintain testing consistency across a variety of testing conditions.

Leak Testing

Figure 35:
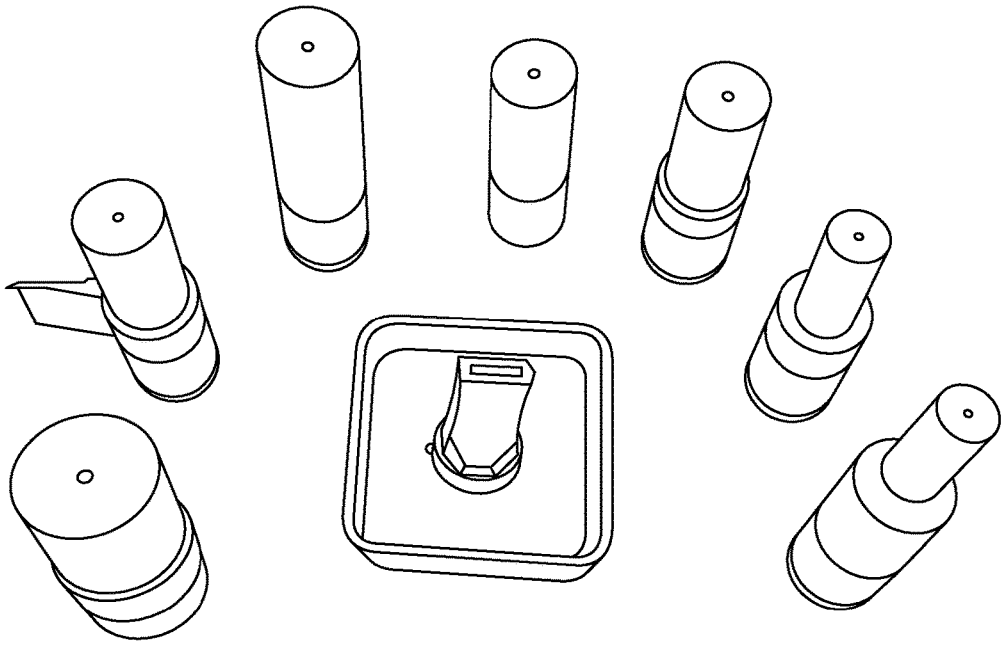
FIG. 35 shows testing rods machined to the same diameter as the combustible products and IQOS 3 (L to R): President cigar, Game Leaf cigar, 1C4 reference cigar, Swisher Sweets untipped cigarillo, 1C3 reference cigar, 1R6F reference cigarette, IQOS 3, and a resin-filled plastic tip of Black & Mild cigarillo were used to test the leak rate between the adaptors and products. (The dimple in the solid rods is from the machining process.)
Figure 36:
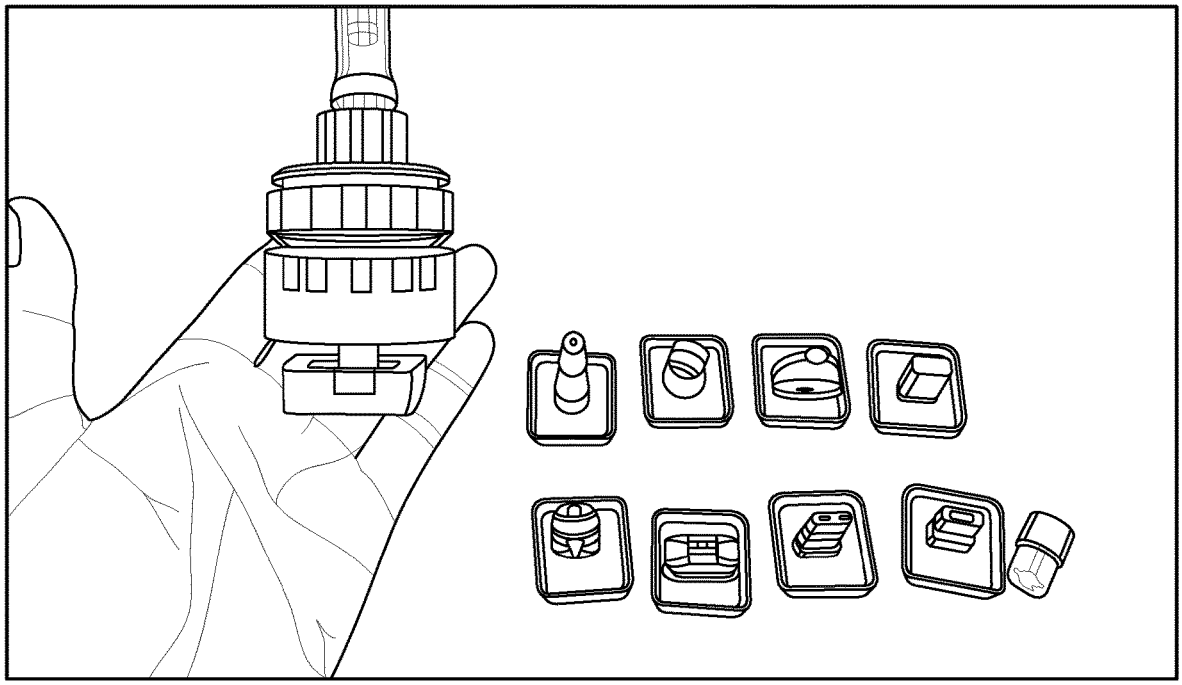
FIG. 36 shows resin-filled mouth-ends of e-cigarettes tested for leakage with the Universal Smoking Machine Adaptor. Mouthpieces are identified as: (top row, L to R) Vuse Vibe, Puff Plus, NJoy Ace, Puff Bar, (bottom row, L to R) Vuse Alto, Evolve Reflex, Bidi Stick, JUUL; (inserted into Universal Smoking Machine Adaptor held in hand on the left) Black & Mild plastic tip. Note: JUUL pod in lower right shown for scale.

A study was conducted to investigate the leakage of the example devices. For combustible products, solid rods, or "dummy" products that matched the dimensions (but not the compressibility) of the commercial product mouth-ends, were machined from ultrahigh molecular weight polyethylene (UHMW-P; FIG. 35). For e-cigarettes, an actual product mouth-end was tested, with the other end sealed in epoxy resin (FIG. 36). Each product was inserted into the adaptor at a 45° angle with the bench and placed under vacuum (−305 mm $H_2O$). A digital pressure gauge (Track-It, Monarch, PN 5396-0338) was used to record the leak rate, measured as the reduction in vacuum over 2 minutes. Three replicates were tested for each adaptor-product combination.

To aggressively evaluate the quality of the product-adaptor seals, the starting vacuum (−305 mm $H_2O$) constitutes twice the maximum pressure drop obtained during puffing of the products according to standardized protocols. These initial data were collected using a single-port smoking machine (UVM, Gram Research) while the puff flow rate envelope was acquired electronically (SPA-D, Sodim; Körber-Technologies).

Figure 37:
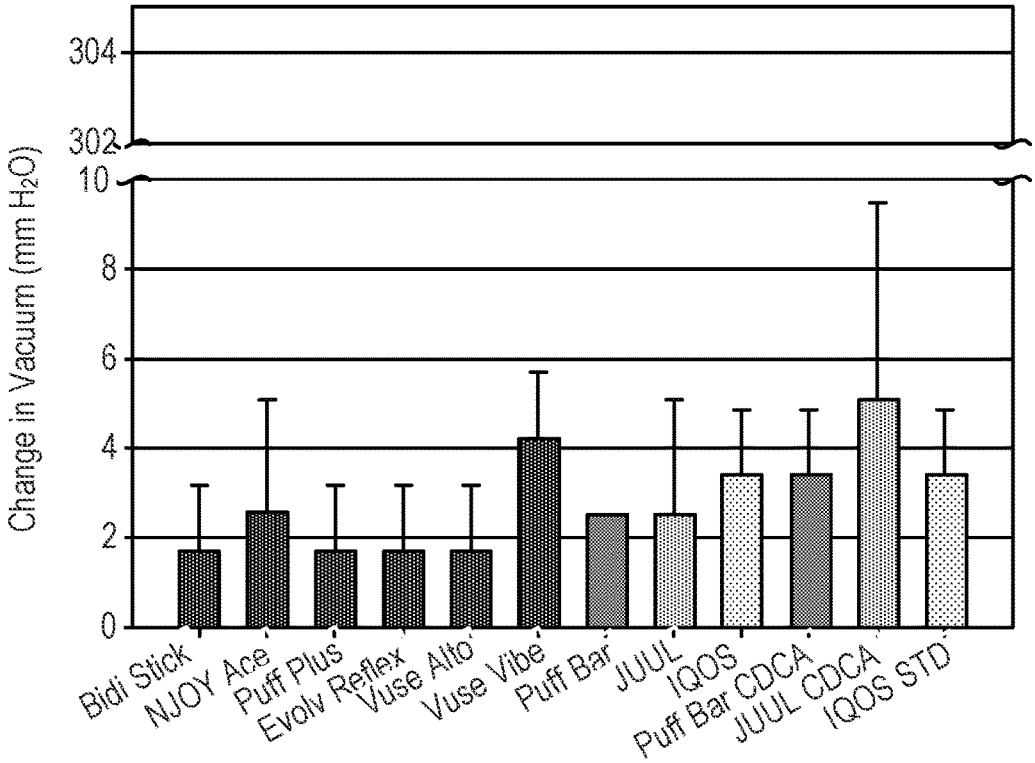
FIG. 37 shows a graph of leak rate testing shown as the reduction in vacuum over a two-minute period for the Universal Smoking Machine Adaptor (USMA) and a CDC proprietary adaptor (CDCA) fitted to e-cigarette mouth-ends. Results are also shown for IQOS with USMA and Cerulean cigarette adaptor (STD). Results are shown as mean of triplicate measurement±SD.
Figure 38:
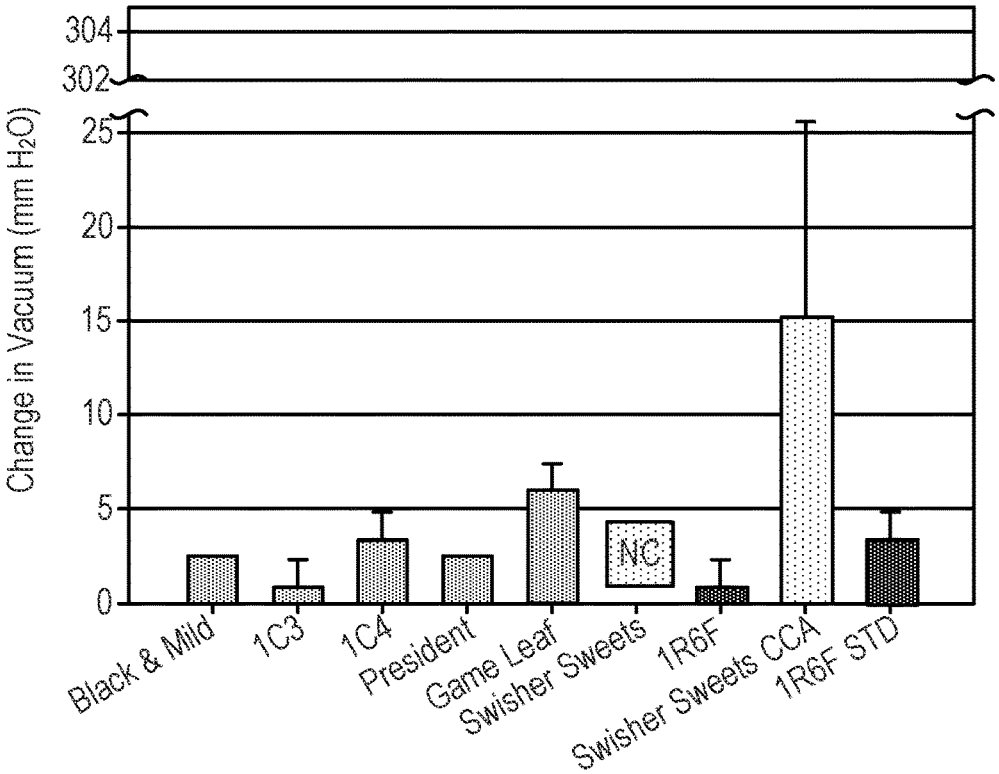
FIG. 38 shows a graph of leak rate testing shown as the reduction in vacuum of the Universal Smoking Machine Adaptor (USMA), standard cigarette adaptor (STD) and Cerulean Cigar Adaptor (CCA) fitted to different combustible tobacco products. "NC"=no change in vacuum detected for all three replicates. Results are shown as mean of triplicate measurements±SD.
Figure 39:
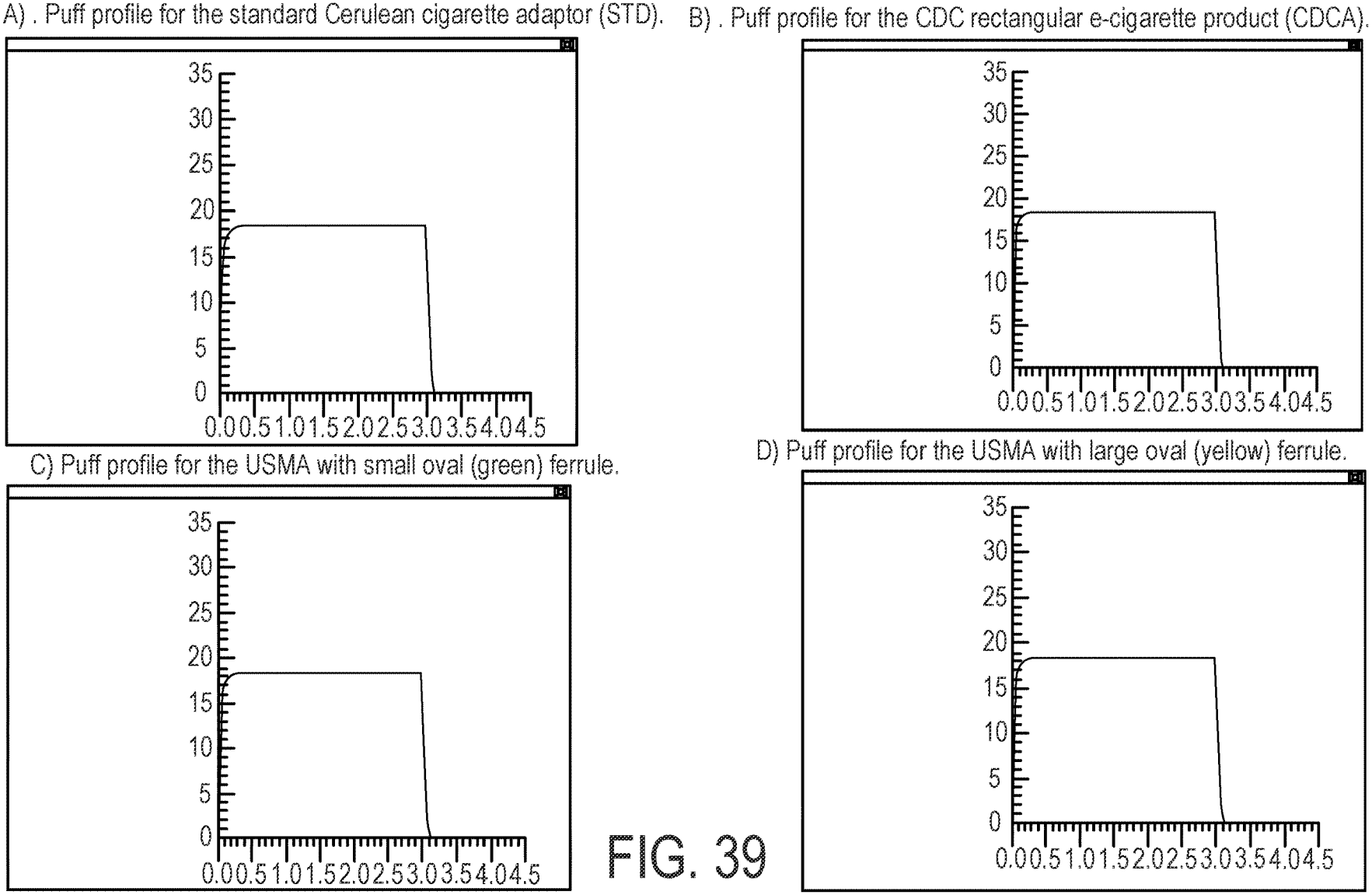
FIGS. 39A-D show typical puff profiles and puff volumes achieved with: A) Cerulean Standard adapter (STD) connected to cylindrical mouth end; B) CDC adapter connected to cuboid mouth end (CDCA); C) Universal Smoking Machine Adapter (USMA) with small oval ferrule (green) and cuboid mouth end; and D) Universal Smoking Machine Adapter (USMA) with large oval ferrule and discorectangular mouth end; all recorded puffs are smooth, square-shaped peaks that show no indication of leaking during machine puffing.

When testing e-cigarettes with the USMA, all leak rates were acceptably low at less than 5 mm $H_2O$ (<2% of starting vacuum) vacuum change over two minutes. Using a t-test (Excel, Microsoft 365), there was no statistically significant difference in the mean leak rate of the USMA compared to the product-specific CDCA when testing the JUUL and Puff Bar e-cigarettes, nor compared to the STD adaptor when testing IQOS and 1R6F (all p values>0.1, see FIG. 37). However, a comparison of the USMA to the CCA was not conducted for five of the cigar and cigarillo products tested because the CCA (unlike the USMA) was not able to hold-305 mm $H_2O$ vacuum when tested with these products or was not able to seal to the mouth end of the Black & Mild plastic-tipped cigarillo. Overall, leak rate testing showed vacuum changes of less than 2% over the two-minute period for the USMA sealing to different tobacco products with a wide variety of mouth ends.

Discussion

The results of the leak test study indicate that the USMA forms a reliable and repeatable seal that meets or exceeds the performance of existing commercial adaptors. Also, the USMA is currently the only adaptor that allows testing of a variety of mouth-end geometries, including e-cigarettes with different shapes and sizes as well as cigarillos with a plastic tip (e.g., Black & Mild). For cigar testing, the USMA is more user-friendly and versatile than the commercially available adaptor in that it has fewer parts (only 11 components to test all the products of this study; see Table 1) and can form a repeatable, leak-tight seal with a wide variety of mouth-end geometries (FIGS. 35-38).

Limitations to these data include the limited number of tobacco products and adaptors tested, and that the dummy products for cigars, cigarillos (except the Black & Mild plastic-tipped cigarillo), cigarette and heated tobacco product were made of rigid plastic, and therefore do not replicate the compressibility of the actual mouth ends. Because the mouth ends for these products include homogenized tobacco leaf and paper wrappers that are porous, it is not possible to form a leak-free seal between the actual mouth ends of these products and any adaptor.

Tobacco Products

A study was conducted to test selected products available in the US commercial market that represent a wide range of product masses, mouth-end geometries, and compressibility (Table 1). The tested products included eight e-cigarette brand—flavor combinations (JUUL—tobacco, Puff Bar—tobacco, Puff Plus—Mango, NJOY Ace—tobacco, Vuse Alto—tobacco, Bidi Stick—Tobacco, Bidi Stick—Mango, and Reflex—unflavored lab-prepared e-liquid), two cigar brands (Dutch Masters President cigar, Game Leaf Garcia Y Vega cigar), one reference cigar (1C4), two cigarillo brands (Swisher Sweets untipped cigarillo, Black & Mild plastic-tipped cigarillo), one reference cigarillo (1C3), one heated tobacco product (IQOS-Amber Rich Tobacco Blend Heatsticks), and one certified reference cigarette (1R6F). All e-cigarettes were labeled as having 5% nicotine salt, except Bidi Stick which was labeled as having 6% nicotine salt. The products were purchased in November 2021 from a single vendor in Atlanta, GA, and brands were from a single manufacturer's lot when possible. The purchased reference products-cigars (1C4), cigarillos (1C3), and certified reference cigarettes (1R6F Small Batch Composition)—were purchased at the same time from the Center for Tobacco Reference Products at the University of Kentucky. There is no available reference e-cigarette product. Therefore, the Reflex (Evolv, USA), a rechargeable device that uses refillable pods with a lab-prepared e-liquid (Table 2) was used as a reference device.

TABLE 1

Commercial and reference tobacco products tested using the Universal Smoking Machine Adaptor and commercially available adaptors.

| Brand | Comparison Adaptor | Reference Product | Puffing Protocol |
|---|---|---|---|
| Machine-Made Cigars | | | |
| Dutch Masters President | CCA | 1C4 | CRM 64 |
| Garcia Y Vega Game Leaf Natural | CCA | 1C4 | CRM 64 |
| Cigarillos | | | |
| Black and Mild Original (plastic tipped) | CCA | 1C3 | CRM 64 |
| Swisher Sweets Classic (untipped) | CCA | 1C3 | CRM 64 |
| Electronic Cigarettes - Refillable Pods | | | |
| JUUL (Virginia Tobacco, 5% nicotine) | CDCA | Reflex | ISO 20768 |
| Vuse Alto (Rich Tobacco, 5% nicotine) | NA | Reflex | ISO 20768 |
| NJOY Ace (Classic Tobacco, 5% nicotine) | NA | Reflex | ISO 20768 |

TABLE 1-continued

Commercial and reference tobacco products tested using the Universal Smoking Machine Adaptor and commercially available adaptors.

| Brand | Comparison Adaptor | Reference Product | Puffing Protocol |
|---|---|---|---|
| Electronic Cigarettes - Disposables | | | |
| Puff Bar (Tobacco, 5% nicotine) | CDCA | Reflex | ISO 20768 |
| Puff Plus (Tobacco, 5% nicotine) | NA | Reflex | ISO 20768 |
| Bidi Stick (Classic Tobacco, Mango, 6% nicotine) | NA | Reflex | ISO 20768 |
| Heated Tobacco Products | | | |
| IQOS 3 (Amber HEETS, Rich Tobacco Blend) | STD | IR6F | HCI T115 |

CCA: Cerulean Cigar Adaptor

CRM 64: CORESTA Recommended Method No. 64, Routine analytical cigar-smoking machine - specifications, definitions, and standard conditions, May 2018

CDCA: CDC JUUL Adaptor

ISO 20768: International Standard: Vapour products - Routine analytical vaping machine Definitions and standard conditions, 2018.

NA: Comparison adaptor not available

STD: Cerulean Standard cigarette adaptor

HCI: Health Canada Intense from Health Canada Test Method T115 - Determination of Tar, Water, Nicotine and Carbon monoxide in mainstream smoke Protocol for the Preparation of Reference E-Liquid (Unflavored 5% Nicotine Salt e-Liquid)

E-liquid components (see "Actual (g)" mass in Table 2) were added to a 500 mL wide-mouth amber glass mason jar (Ball Corporation, Broomfield, CO, US) using a top-loading balance (ML802T100, Mettler Toledo, Columbus, OH, US). Benzoic acid (USP/FCC, Fisher Chemical, Fair Lawn, NJ, US) granules were ground into a fine powder using a glass mortar and pestle. S-Nicotine (>99% GC, Sigma-Aldrich, St. Louis, MO, US), ethanol (USP, 200 proof, Spectrum Chemical Mfg Corp, New Brunswick, NJ, US), and benzoic acid were added into the mason jar and mixed well. Then, glycerin (99.7% USP grade, Chemworld, Roswell, GA, US) and propylene glycol (USP/FCC, Fisher Chemical, Fair Lawn, NJ, US) were added to the mason jar and mixed using an Innova 2100 orbital shaker (New Brunswick Scientific Co, Edison, NJ, US) until the benzoic acid powder was dissolved completely. E-liquid was refrigerated until poured into "unicorn" dispensing vials (30 mL each) specially designed for refilling e-liquid pods.

TABLE 2

Quantities of the components used to prepare the standard e-liquid for quality control.

| | Unflavored 5% Nicotine Salt e-liquid | |
|---|---|---|
| | Target (g) | Actual (g) |
| Glycerol | 369.81 | 369.80 |
| Propylene glycol | 158.49 | 158.49 |
| S-nicotine | 30.00 | 30.00 |
| Benzoic acid | 23.70 | 23.70 |
| Ethanol | 18.00 | 18.01 |
| Total weight (g) | 600.00 | 600.00 |
| Nicotine (mg/g) | 50.00 | 50.00 |
| VG/PG | 70/30 | 70/30 |

Pressure Drop and Puff Profile Testing

A puff profile analyzer (Cerulean VFA450) was used to collect flow rate and pressure drop data during the puffing of products attached separately to the USMA and comparison adaptors. Each adaptor-e-cigarette combination was attached to a single port of an 8-port vaping machine (CETI-8, Cerulean, Milton Keys, Buckinghamshire, UK), and each e-cigarette was vaped while continuously recording flow rate and pressure drop for each puff. Machine vaping was conducted according to a standardized puffing regimen (55-mL puff volume, 3-s puff duration, 30-s puff interval, square puff profile). A calibrated soap bubble meter (Flow meter R24.01, Model No. 80241530, Körber-Technologies, Germany) was used to verify puff volume accuracy, as specified by ISO 3308.

E-Cigarette Emissions Testing

The USMA and CDCA were tested by machine vaping one pod-based and one disposable e-cigarette brand (JUUL and Puff Bar, respectively). Five additional e-cigarette brands were tested with only the USMA because a comparison adaptor for these mouth-end geometries was not commercially available. For each replicate, fifteen puffs were taken according to a standardized puffing regimen (3 s duration, 55 mL volume, 30 s puff interval, square-shaped puff profile). TPM was collected from all e-cigarettes on 44 mm filter pads, which were collected and stored according to a standardized method prior to analysis. The wetted parts of the USMA and CDCA adaptors were rinsed with methanol and let them air dry after each smoking replicate.

Cigar and Cigarillo Emissions Testing

The USMA and CCA were tested by machine smoking two cigar and two cigarillo (plastic-tipped and no tip) brands according to a standardized puffing regimen (1.5 s duration, 20 mL volume for product diameters≤12 mm or volume=0.139×diameter2 for product diameters>12 mm, every 40 s). Following CORESTA guidelines, the cigar butt termination line was marked at 33 mm from the mouth end of the cigar and cigarillo. For plastic-tipped cigarillos with the tip left intact (USMA only), the butt length was marked at 17 mm from the end of the mouthpiece. TPM from all cigars was collected on 55 mm filter pads and stored according to a standardized method prior to analysis. The wetted parts of the USMA and CCA adaptors were rinsed with methanol and let them air dry after each smoking replicate.

Heated Tobacco Product and Certified Reference Cigarette Emission Testing

The USMA and STD were tested by machine smoking a heated tobacco product (IQOS) and a certified reference cigarette (1R6F). It was not possible to accurately measure the product mass consumed for IQOS, as some mass loss occurs (filler loss as HeatStick is removed from the heating device). The mass of product consumed was also not recorded for the reference cigarette. IQOS and 1R6F testing was conducted according to a standardized puffing regimen (2 s duration, 55 mL volume, every 30 s, ventilation holes 100% blocked). For the 1R6F, the ventilation holes were taped when smoking with the USMA and blocked when smoking with the Canadian Intense Lip version of the STD. Ten puffs were taken from IQOS for each smoking session, and for 1R6F, the session was stopped at the butt termination line, which is 3 mm past the overwrap, per the ISO method. TPM from the reference cigarette and IQOS were collected on 44 mm filter pads and stored according to a standardized method prior to analysis. The wetted parts of the USMA and STD adaptors were rinsed with methanol and let them air dry after each smoking replicate.

Tobacco Product Mass Consumption

Tobacco products were tested with a vaping/smoking machine (CETI-8 for e-cigarettes, SM450-CV for cigars and cigarillos, SM450 for IQOS and 1R6F, all manufactured by Cerulean) in a horizontal orientation for combustible products and IQOS and at 45° angle for e-cigarettes. Each product was weighed (except for IQOS and 1R6F) pre- and post-vaping/smoking using a five-digit precision analytical balance (Model XPE205, Mettler-Toledo) and calculated product mass consumption as the difference in mass pre- and post-vaping/smoking.

Gravimetric Measurement of TPM

Before and after vaping/smoking sessions, the adaptor was capped (3D printed plug for USMA and manufacturer's end cap for all other adaptors) and weighed using the analytical balance (5-digit balance, Model XPE205, Mettler-Toledo). TPM collected on the filter was calculated as the difference between the adaptor mass pre- and post-vaping/smoking. For IQOS and 1R6F, smoke was collected from 2 HeatSticks and 3 cigarettes on the same filter pad, respectively; one pad per product was used for all other products.

Nicotine Quantification for E-Cigarettes

The CDC method for nicotine quantification was used with minor modifications to extend the calibration range. Briefly, the filter pad was extracted with 10 mL of methanol spiked with internal standard solution (nicotine-d4). Nicotine was analyzed using gas chromatography with mass selective detection (Agilent 7890A GC interfaced to an Agilent 5975C mass selective detector). The study used relative ratios of the analyte and internal standard signals for quantification compared to a linear calibration curve (0.004 to 1 mg/mL nicotine). The study calculated the fraction of nicotine in the TPM as the mass of nicotine divided by the mass of TPM.

Nicotine Quantification for Cigarettes, Cigars, and IQOS

For analysis of cigars, cigarillos, cigarettes, and IQOS, the study used the CDC method for tar, nicotine, and carbon monoxide (TNCO) quantification. The method utilizes a gas chromatograph coupled with a flame ionization detector for nicotine analysis and thermal conductivity detector for water analysis (GC-FID/TCD; Agilent 6890 GC, Model G1530A). Filter pads were extracted with 20 mL of extraction solution for cigarettes and 40 mL of extraction solution for cigars. Extraction solution consisted of a 4 L bottle of 2-propanol mixed with 400 μL of trans-Anethole (Acros Organics acquired by Thermo Fisher Scientific, ≥98.5% purity), the internal standard for nicotine, and 6 mL of methanol (Thermo Fisher Scientific, 99.8%), the internal standard for water quantification. The study determined the relative ratios of the analyte and internal standard signals and compared to a linear calibration curve (0.004 to 1 mg/mL nicotine).

Quality Control

Before testing commercial products, the study generated a quality control pool of 20 measurements over 20 days (1 measurement/day) from the reference e-cigarette (Reflex) and 1R6F, and 40 measurements over 20 days (2 measurements/day) for the reference cigarillo and cigar (1C3 and 1C4). During the testing of the commercial e-cigarettes, each vaping run contained a QChigh [Reflex (H), 15 puffs taken] and QClow [Reflex (L), 8 puffs] sample. During the testing of the 1R6F reference cigarette, reference cigar and cigarillo, each smoking run contained a QChigh and QClow (10 times dilution) sample. Throughout testing of all tobacco products, if any reference product (QC sample) failed the Westgard acceptability criteria, the study retested the commercial products and rejected the data from the "failed" run.

Statistical Analysis

The study used non-parametric Wilcoxon Rank Sum tests to compare the results of the USMA to each comparison adaptor for a given product. The study did not remove outliers determined using the interquartile range method before generating tabular and graphical data summaries, but in the Results section, the study describe the impact of removing any outliers. To quantify precision, the study calculated the relative standard deviation (RSD) across the replicates for all products.

Results

Seal Reliability: Pressure Drop and Puff Profile Testing

The continuous flow rate collected during the puffing, or the puff profile, and mean volume data were not different when puffing using the USMA versus the comparison adaptor for each tobacco product tested, as shown in FIGS. 39A-D. The puff volume for the STD was 55.24 mL, for the CDCA 55.06 mL, for the USMA 55.02 mL (small oval ferrule) and 55.01 mL (large oval ferrule). All three adaptors (STD, CDCA, and USMA) met the CORESTA Recommended Method Number 81 puff volume specification of 55±0.3 mL. Pressure drop comparison, in addition to puffing flow rate examination, showed no abnormal puff profiles indicating that all adaptors do not perturb the flow path nor restrict the flow or show evidence of a leak around the product.

Smoking Outcome Comparisons

The summary statistics for comparison testing of the USMA with other e-cigarette, cigar, and cigarette adaptors are presented in Table 3, with statistically significant differences ($p<0.05$) in distribution highlighted in bold. The data summary for the remaining six commercial e-cigarettes tested using the USMA only is also presented in Table 3. All products were tested in replicates of 10, except where noted.

TABLE 3

Tobacco product mass consumed, and mainstream emissions collected using the Universal Smoking Machine Adaptor (USMA), CDC Adaptor (CDCA), Cerulean Cigar Adaptor (CCA), and Cerulean standard cigarette adaptor (STD).

| Tobacco Product | Adaptor | Replicates | Mass Consumed (mg) | TPM (mg) | Nicotine yield (mg) | % Nicotine/ TPM | Number of Puffs |
|---|---|---|---|---|---|---|---|
| | | | Electronic cigarettes | | | | |
| JUUL | USMA | 10 | **27.86 ± 5.10**** | **34.02 ± 8.40*** | **1.15 ± 0.22**** | 3.5 ± 0.7 | 15 |
| | CDCA | 10 | 19.92 ± 5.32 | 23.49 ± 7.90 | 0.83 ± 0.25 | 3.7 ± 1.3 | 15 |
| Puff Bar | USMA | 10 | 114.90 ± 7.90 | 117.1 ± 9.84 | 4.03 ± 0.44 | 3.4 ± 0.2 | 15 |
| | CDCA | 10 | 112.10 ± 7.89 | 114.0 ± 8.85 | 3.87 ± 0.41 | 3.4 ± 0.2 | 15 |
| Puff Plus | USMA | 10 | 106.44 ± 5.40 | 107.34 ± 8.77 | 3.58 ± 0.25 | 3.4 ± 0.3 | 15 |
| NJOY Ace | USMA | 10 | 88.17 ± 23.64 | 85.97 ± 16.49 | 3.46 ± 0.69 | 4.0 ± 0.3 | 15 |
| Vuse Alto | USMA | 10 | 90.61 ± 3.05 | 95.31 ± 3.15 | 4.13 ± 0.19 | 4.3 ± 0.2 | 15 |
| Bidi Stick Tobacco | USMA | 9 | 72.78 ± 8.01 | 77.78 ± 8.50 | 3.40 ± 0.37 | 4.4 ± 0.4 | 15 |
| Bidi Stick Mango | USMA | 10 | 72.91 ± 3.17 | 77.88 ± 5.62 | 3.82 ± 0.18 | 4.9 ± 0.2 | 15 |
| Reflex (H) | USMA | 20 | 156.27 ± 32.92 | 158.28 ± 34.35 | 6.85 ± 1.34 | 4.6 ± 1.36 | 15 |
| Reflex (L) | USMA | 20 | 90.16 ± 31.42 | 93.08 ± 30.77 | 3.07 ± 0.44 | 3.5 ± 0.8 | 18 |
| | | | Cigars | | | | |
| Dutch Master | USMA | 10 | **6,144.3 ± 285.70*** | 155.92 ± 15.55 | 8.83 ± 2.00 | 5.6 ± 0.8 | 64.27 ± 4.50 |
| | CCA | 10 | 5,860.5 ± 208.95 | 140.55 ± 18.50 | 8.67 ± 1.50 | 6.2 ± 0.7 | 67.92 ± 6.23 |
| Game Leaf | USMA | 9 | 1,858.8 ± 92.27 | 50.06 ± 18.87 | 3.10 ± 1.75 | 5.8 ± 1.3 | 44.34 ± 7.58 |
| | CCA | 10 | 1,794.7 ± 120.42 | 46.97 ± 8.49 | 3.05 ± 0.85 | 6.4 ± 1.1 | 44.89 ± 3.84 |
| 1C4 | USMA | 25 | 2,099.2 ± 94.76 | **76.79 ± 8.05**** | 3.80 ± 0.39 | 5.0 ± 0.4 | 40.05 ± 3.31 |
| | CCA | 23 | 2,133.2 ± 120.27 | 69.06 ± 5.70 | 3.68 ± 0.49 | **5.3 ± 0.4*** | 41.16 ± 3.22 |
| | | | Cigarillos | | | | |
| Swisher Sweets | USMA | 10 | 1,839.0 ± 58.05 | 67.16 ± 5.06 | 2.40 ± 0.25 | 3.6 ± 0.2 | 38.19 ± 5.42 |
| | CCA | 10 | 1,862.0 ± 74.32 | 65.13 ± 4.32 | 2.39 ± 0.18 | 3.7 ± 0.2 | 35.77 ± 1.50 |
| Black & Mild (plastic tip removed) | USMA | 10 | 1,703.7 ± 102.92 | **68.71 ± 6.41*** | 2.09 ± 0.07 | 3.1 ± 0.3 | 35.10 ± 3.70 |
| | CCA | 10 | 1,602.3 ± 172.34 | 60.84 ± 7.82 | 2.09 ± 0.17 | **3.5 ± 0.2**** | 34.71 ± 5.02 |
| 1C3 | USMA | 26 | 1,853.0 ± 73.18 | **68.23 ± 4.83**** | 1.95 ± 0.23 | 2.9 ± 0.2 | 35.62 ± 1.97 |
| | CCA | 22 | 1,805.4 ± 115.61 | 62.85 ± 2.50 | 1.95 ± 0.14 | 3.1 ± 0.2 | 35.22 ± 2.37 |
| | | | Heated tobacco product (IQOS) | | | | |
| IQOS | USMA | 10 | — | 79.36 ± 7.18 | 0.94 ± 0.16 | 1.2 ± 0.1 | 10 |
| | STD | 10 | — | **85.14 ± 2.44*** | 0.89 ± 0.17 | 1.0 ± 0.2 | 10 |
| | | | Reference cigarette (1R6F) | | | | |
| 1R6F | USMA | 20 | — | 140.32 ± 9.34 | 1.98 ± 0.12 | 1.4 ± 0.1 | 8.64 ± 0.27 |
| | STD | 20 | — | 144.93 ± 8.27 | **2.17 ± 0.15**** | **1.5 ± 0.1**** | **8.88 ± 0.34*** |

Results are reported as Mean + SD. Statistically significant differences (*$p < 0.05$) and (**$p < 0.01$) between USMA and the other adaptors are highlighted in bold font and shown next to the highest level in each comparison. The study tested all e-cigarettes in 10 replicates except for Bidi Stick Tobacco ($n = 9$) due to a device failure and Reflex ($n = 20$) which was used for QC runs. Bidi Stick was tested in two flavors (tobacco and mango). Nicotine yield and nicotine fraction in TPM were significantly different ($p = 0.0057$ and 0.0009, respectively) between the two Bidi Stick flavors when tested using the USMA.

E-Cigarettes

There were no significant differences in product mass consumed between the two adaptors for Puff Bar, but mass consumed for JUUL was significantly greater for the USMA than the CDCA. Although the CDCA was originally designed for JUUL in 2018, the size of the JUUL product is now slightly smaller possibly causing some leakage of air between the product mouth end and CDCA, effectively reducing the flow through the JUUL device. Puff Bar, being slightly larger and more rigid than the modern-day JUUL, likely formed a better seal with the CDCA which resulted in similar TPM, mass consumption, and nicotine yield for the two adaptors. In contrast, the potential leakage between the CDCA holder and the JUUL mouth end is evidenced by higher mass consumption, TPM, and nicotine yield when testing with the USMA (40%, 45%, and 38% higher, respectively). Nicotine yield normalized by TPM was not different for the e-cigarettes and adaptors tested.

Cigars and Cigarillos

Overall, cigar and cigarillo smoke yields showed limited differences between the USMA and the CCA. These include slightly higher cigar mass consumption (5% higher) of the Dutch Masters cigar when tested using the USMA. Additionally, higher TPM was observed in 1C4, 1C3, and Black & Mild (plastic tip removed) when tested using the USMA compared to the CCA (11%, 13%, and 9%, respectively). Nicotine yield was not different between the two adaptors for all products. However, nicotine expressed as a fraction of TPM was lower for 1C4 and Black & Mild (plastic tip removed) when tested with the USMA (6% and 11%, respectively).

The USMA is currently the only adaptor that allows testing of cigarillos with the plastic tip kept intact (e.g., Black & Mild), which is how the product is typically smoked. A summary of the data collected on Black & Mild cigarillos using the USMA with the plastic tip cut off or kept intact is shown in Table 1. When the study normalized TPM and nicotine by the product mass consumed, since the butt termination point was different per the CRM 64 protocol, there were no significant differences when smoking Black & Mild with the USMA with tip intact versus removed. However, more mass was consumed, and a higher number of puffs was recorded (leading to higher TPM and nicotine yield) with the tip left intact which highlights the importance of testing these cigarillos with the tip intact as they are typically smoked by consumers.

Heated Tobacco Product and 1R6F

For the IQOS, TPM was lower when testing with the USMA vs. the STD (7%). In the certified reference cigarette (1R6F) that was tested alongside the HTP, nicotine expressed as both yield and as a fraction of the TPM, and number of puffs, were also lower when testing using the USMA vs. the STD (9%, 7%, 3%). However, results generated using the USMA were in better agreement with the certified values for the 1R6F, as shown in Table 4.

TABLE 4

Comparison of TPM and nicotine emissions for the Universal Smoking Machine Adaptor and the Cerulean standard adaptor to the 1R6F certified values.

| | 1R6F | | USMA (n = 10) | | STD (n = 10) | |
|---|---|---|---|---|---|---|
| Analysis | Mean, mg/rod | Certified Uncertainty | Mean, mg/rod | Error, % | Mean, mg/rod | Error, % |
| TPM | 46.8 | 3.5 | 46.77 | 10.0 | 48.31 | 3.2 |
| Nicotine | 1.90 | 0.13 | 1.98 | 4.2 | 2.17 | 14.2 |

Data Variability

Variability in the data was judged to be acceptable if the standard deviation fell within 20% of the mean (20% RSD). Variability was compared to the within-lab data variability reported in recent CORESTA reports on emissions testing of 4 commercial e-cigarettes by 20 labs and 7 commercial cigars by 10 labs.

Product Mass Consumption

Figure 40:
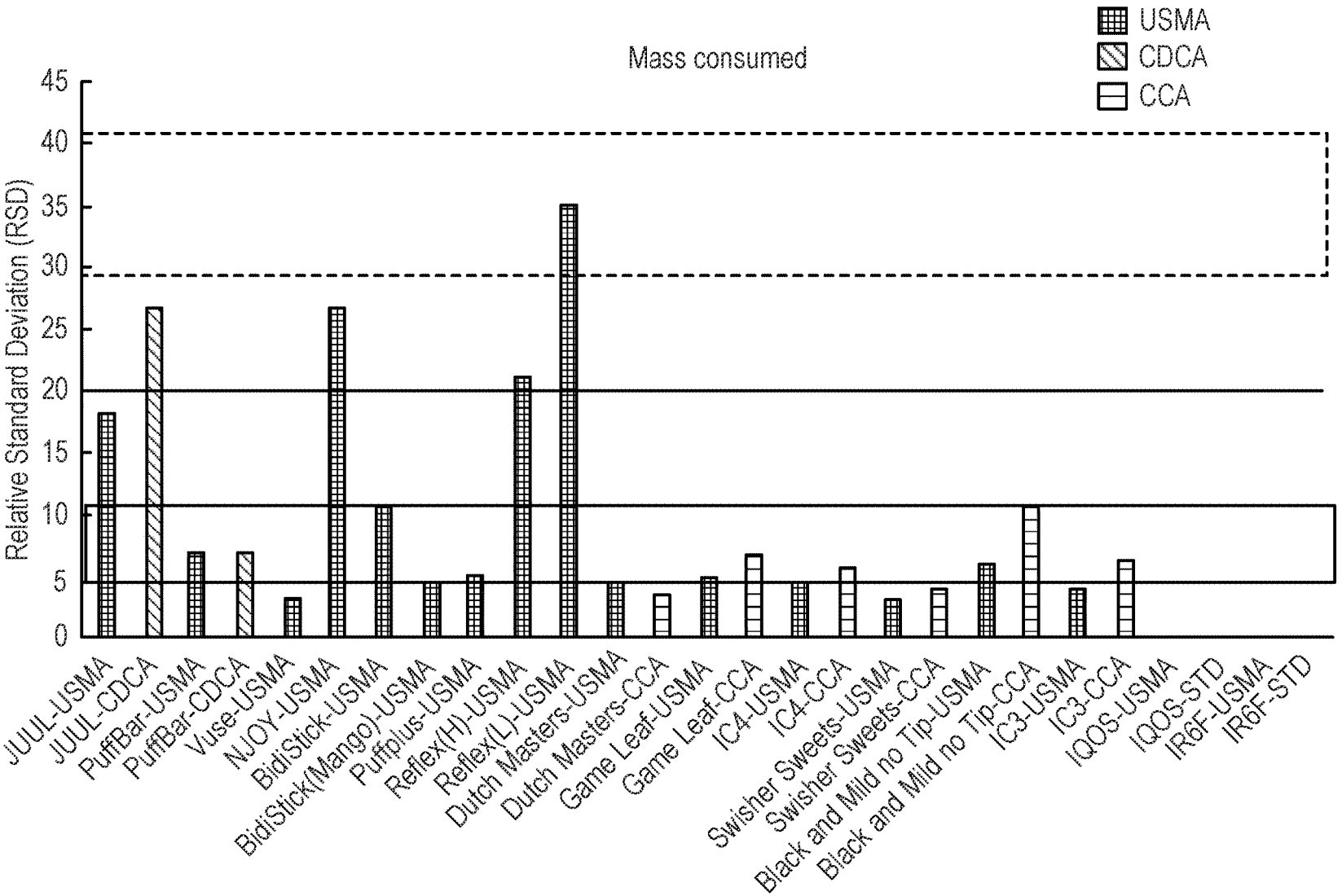
FIG. 40 shows a graph of the relative standard deviation of the product consumption across replicates of tobacco products tested. The solid black line represents the 20% RSD threshold, the dashed red box represents the range of intra-laboratory RSD from a recent CORESTA report on 4 e-cigarette devices tested in 20 different labs, and the solid red box represents the range of intra-laboratory RSD from a recent CORESTA report on 7 cigars tested in 10 different labs.

For e-cigarette product consumption, all measurements with the USMA fell within a ±20% RSD range (FIG. 40), and well below the CORESTA-reported intra-laboratory variability (29-41%) except for NJOY and Reflex. Once 2 outliers were removed (per the interquartile range method) the RSD for NJOY fell from 26.8% to 8.6%. For cigars and cigarillos, the study's data was within the variability range reported in a recent CORESTA report (4-10% RSD). Product mass consumption data for the HTP and 1R6F were not collected.

Total Particulate Matter

Figure 41:
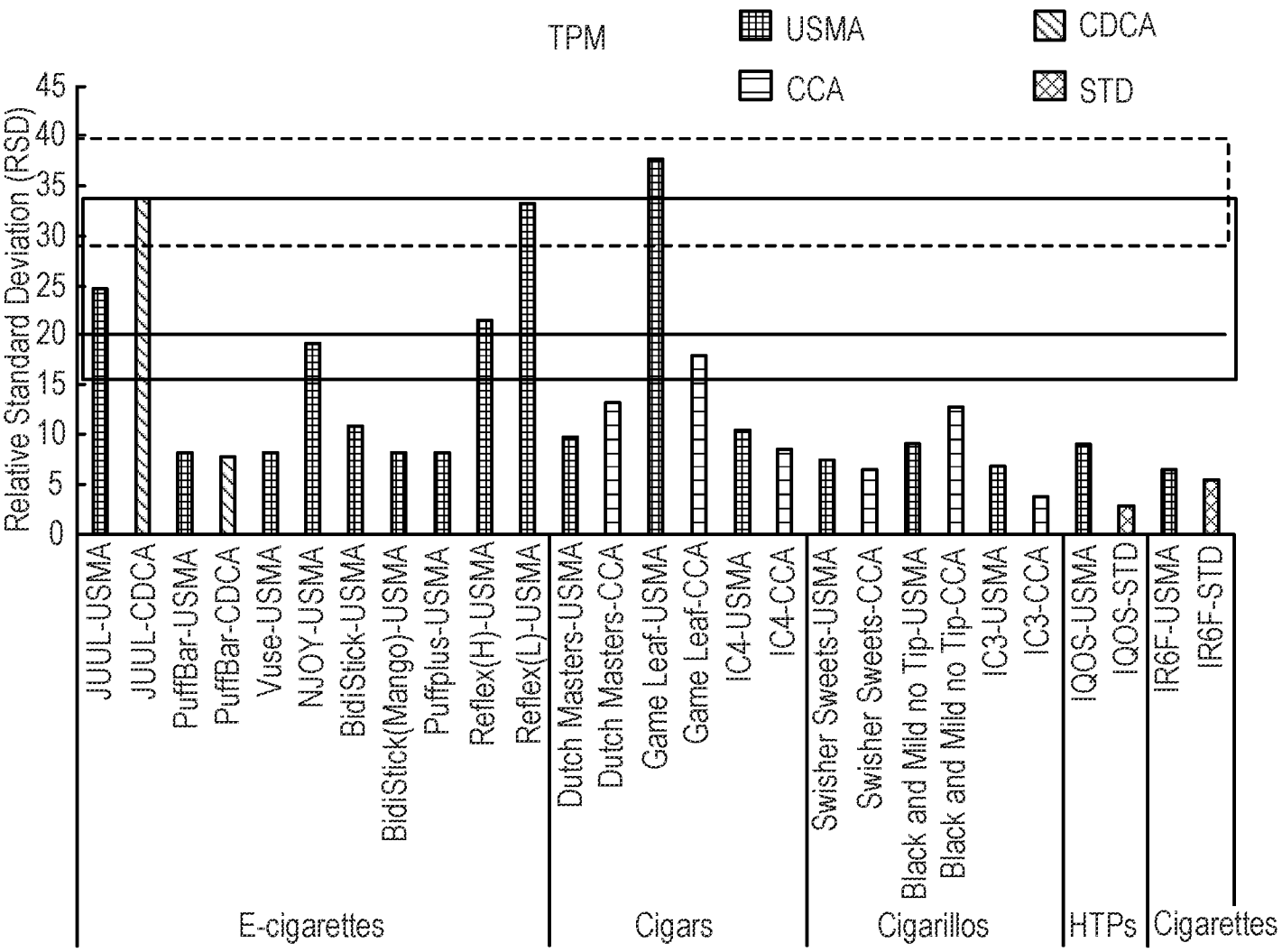
FIG. 41 shows a graph of the relative standard deviation of the TPM across replicates of tobacco products tested. The solid black line represents the 20% RSD threshold, the dashed red box represents the range of within-lab RSDs from a recent CORESTA report on 4 e-cigarette devices tested in 20 different labs, [25] and the solid red box represents the range of within-lab RSDs from a recent CORESTA report on 7 cigars tested in 10 different labs. [26] HTPs: Heated Tobacco Products.

The TPM collected for all products tested is shown in FIG. 41. The variability in the TPM data mirrors that in product mass consumption except for four products. Variability in the USMA data for JUUL and Reflex exceeded 20%. For JUUL, the removal of one outlier drops the RSD from 24.7% to 16.5%. A higher variability was recorded when testing JUUL with CDCA.

For cigars and cigarillos, the RSD was within 20% for all products tested with the USMA, except for the Game Leaf cigar, which exceeded the upper range for intra-laboratory variability in the CORESTA report (15-34%). The variability in TPM data collected from smoking IQOS and 1R6F is well below the 20% threshold.

Nicotine Yield and Number of Puffs

Figure 42:
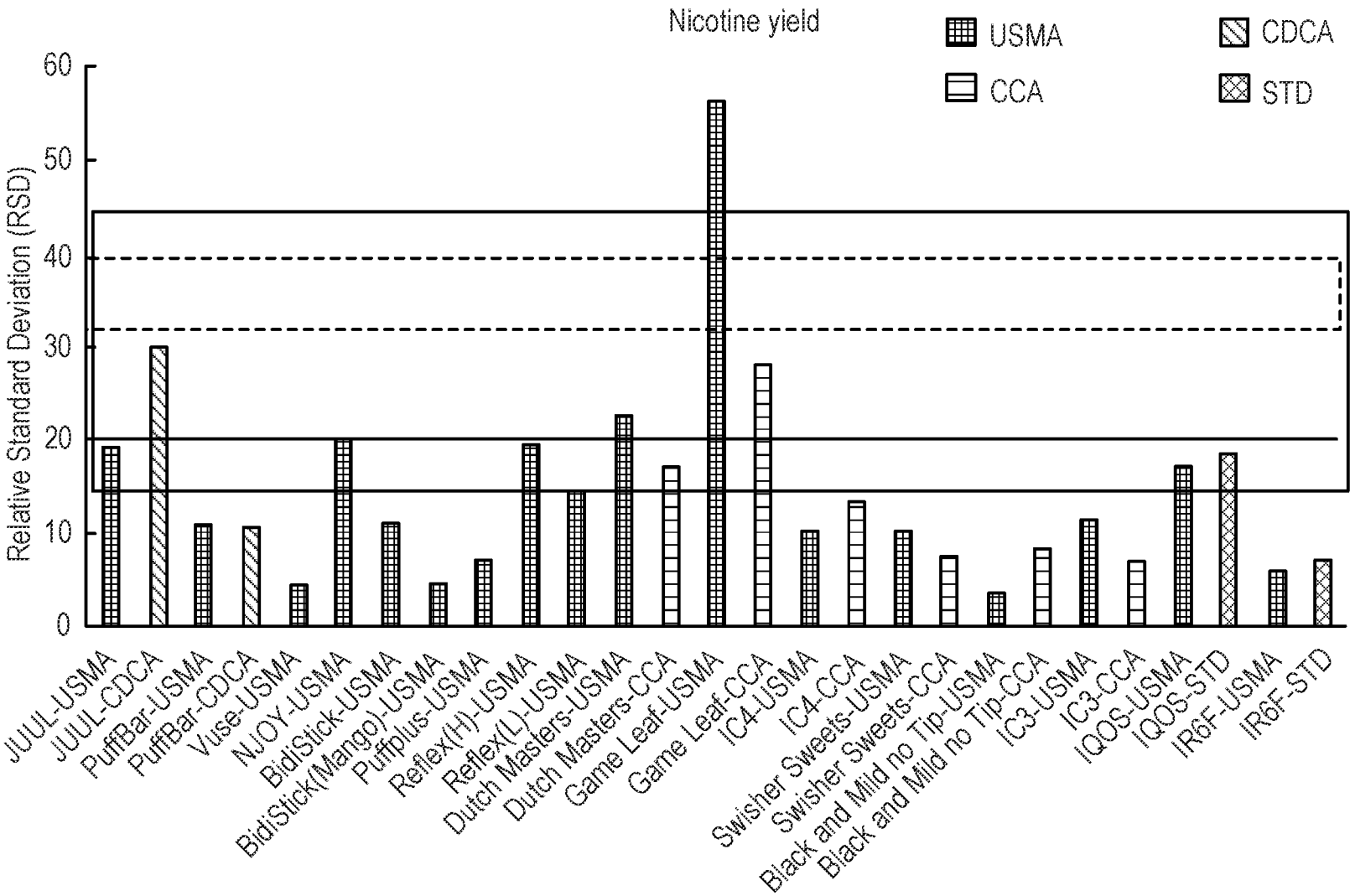
FIG. 42 shows a graph of the relative standard deviation of the nicotine yield across replicates of tobacco products tested. The solid black line represents the 20% RSD threshold, the dashed red box represents the range of intra-laboratory RSD from a recent CORESTA report on 4 e-cigarette devices tested in 20 different labs, and the solid red box represents the range of intra-laboratory RSD from a recent CORESTA report on 7 cigars tested in 10 different labs.

Nicotine yield showed greater repeatability as RSD values for all e-cigarettes tested using the USMA fell within 20% RSD (FIG. 42). For cigars, nicotine yield showed comparable repeatability to the TPM data except for some instances. Nicotine yield variability exceeded 20% for both the USMA and CCA for the Game Leaf cigar. Variability in IQOS nicotine yield was approximately double that reported for the 1R6F for both adaptors. This may indicate poor uniformity in IQOS heating and nicotine delivery.

Figure 43:
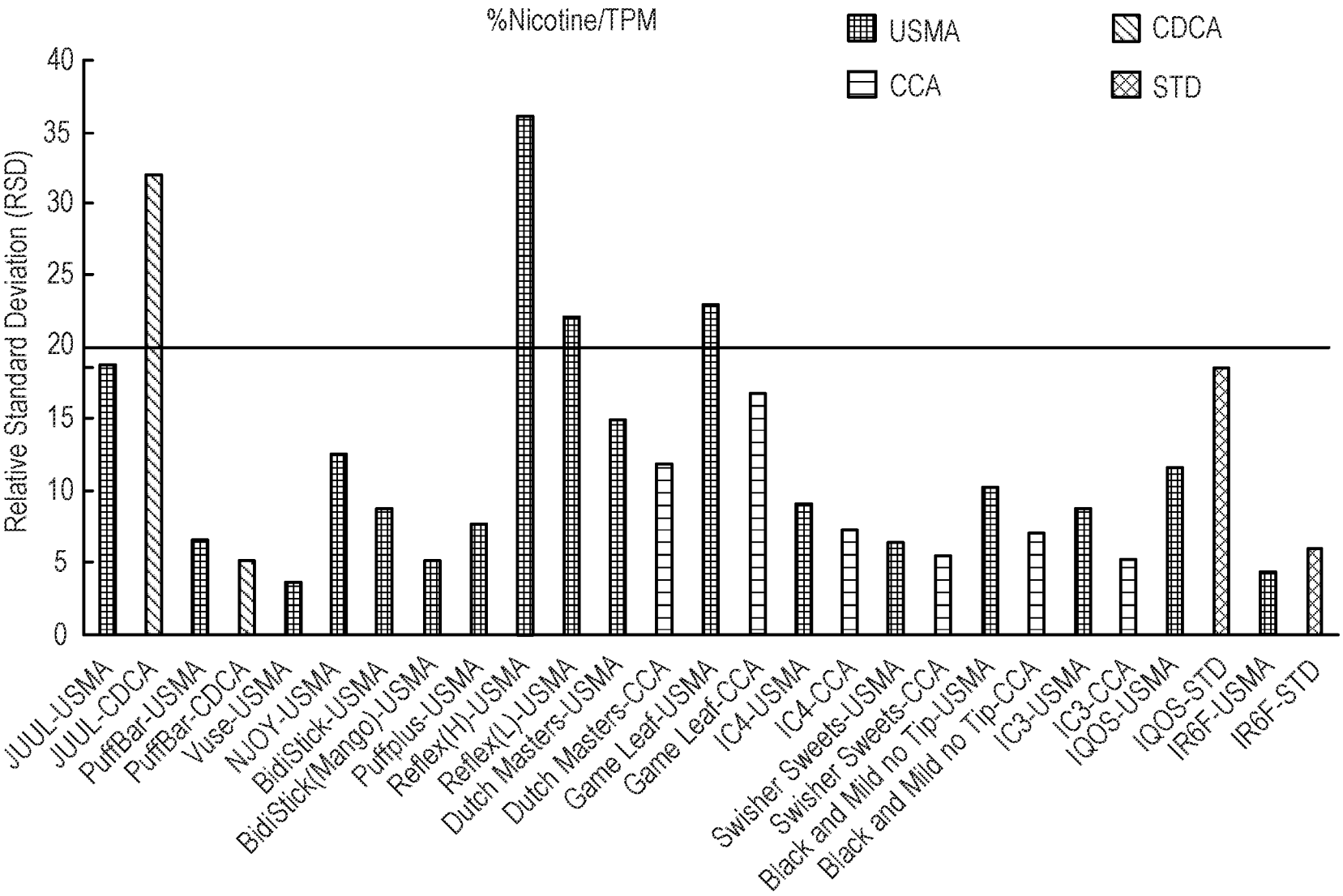
FIG. 43 shows a graph of the relative standard deviation of the nicotine fraction in the total particulate matter (TPM) across replicates of tobacco products tested. The solid black line represents the 20% RSD threshold.

The RSD of the fraction of nicotine in TPM generated from all products showed similar variability as discussed before (FIG. 43). Nicotine is usually a fixed fraction of smoke, hence the outliers that yielded lower TPM also yielded lower nicotine yield.

Figure 44:
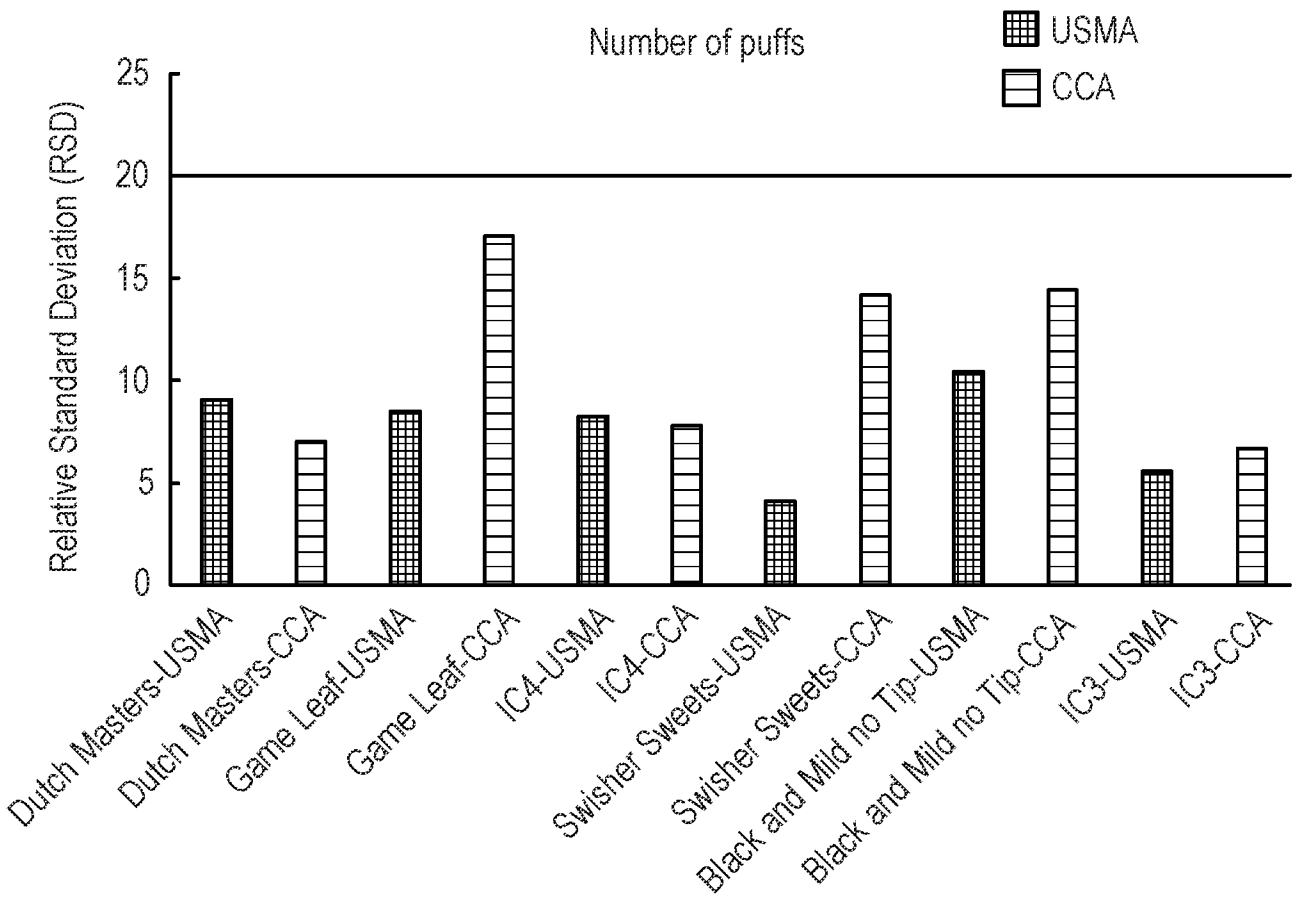
FIG. 44 shows a graph of the relative standard deviation of the number of puffs across replicates of cigars and cigarillos tested. The solid black line represents the 20% RSD threshold.

RSD of the number of puffs taken in a smoking session of cigars and cigarillos is shown in FIG. 44. Variability in the number of puffs fell under the 20% threshold and was well within the CORESTA-reported data range.

Data Distribution

Figure 45:
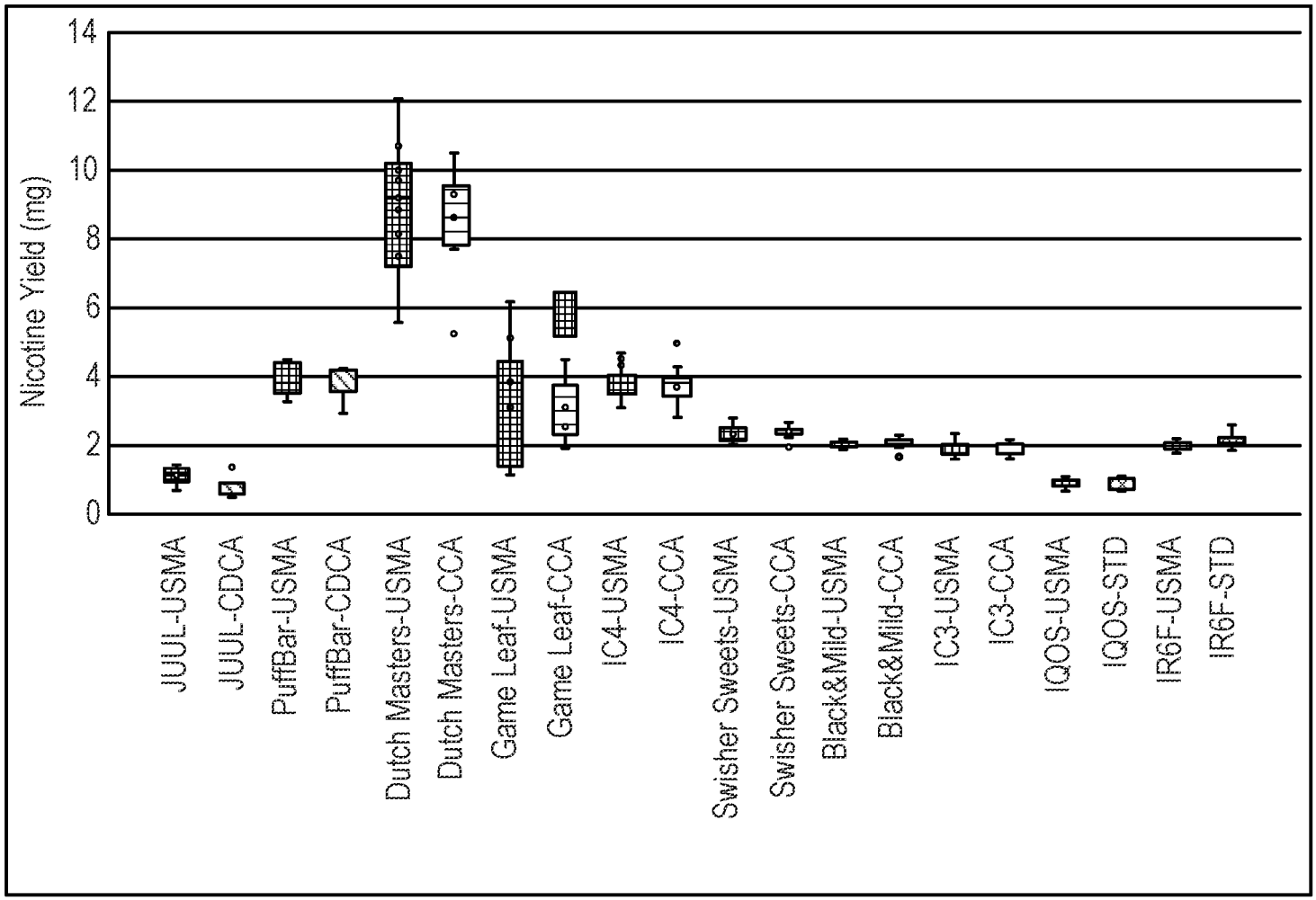
FIG. 45 shows box plot comparison of nicotine yield from e-cigarettes, cigars, cigarillos, IQOS, and 1R6F reference cigarette sampled using the Universal Smoking Machine Adaptor (USMA), CDC adaptor (CDCA), Cerulean Cigar Adaptor (CCA), and Cerulean standard cigarette adaptor (STD).
Figure 46:
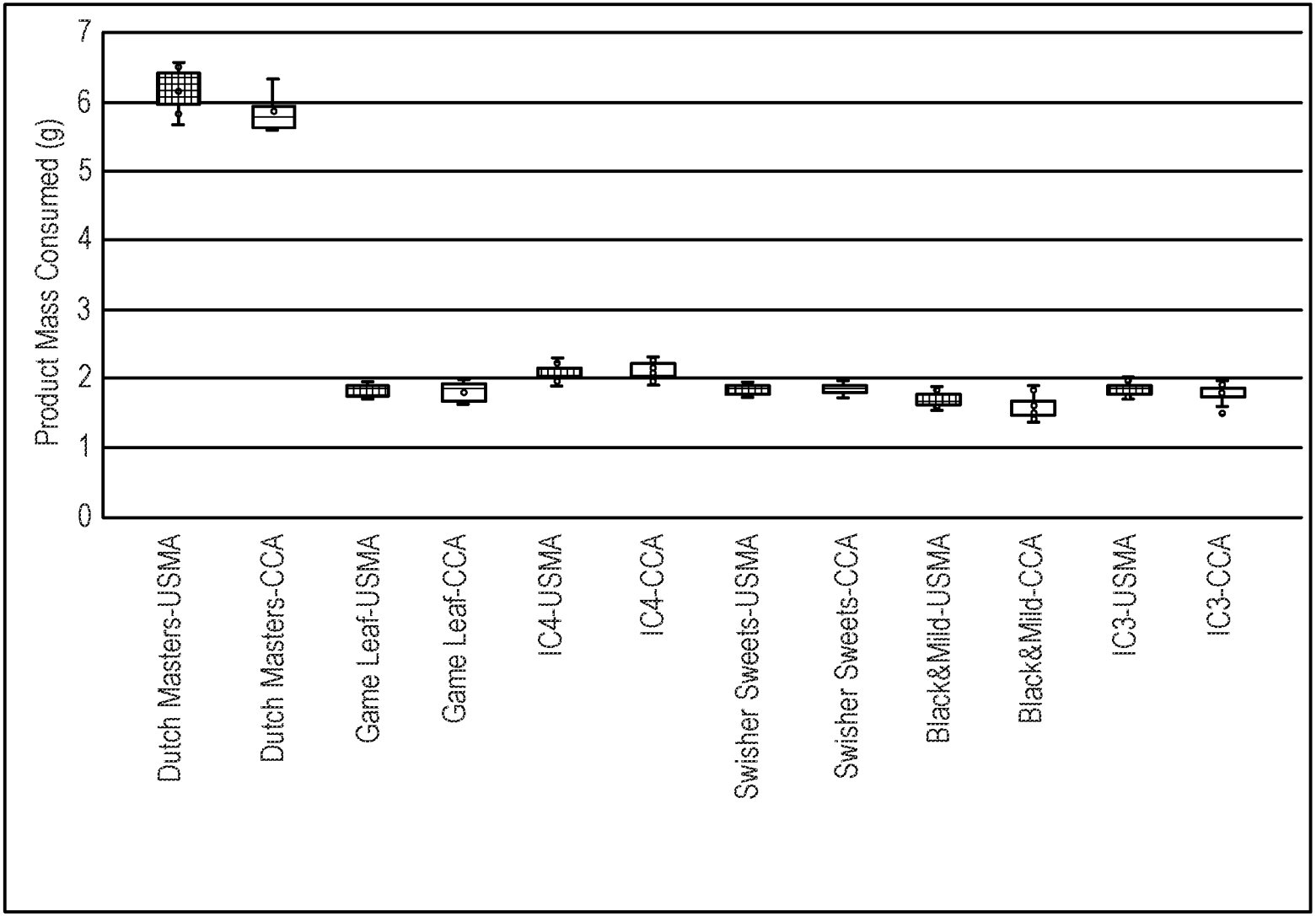
FIG. 46 shows a box plot comparison of the product mass consumption for cigars and cigarillos smoked using the universal smoking machine adaptor (USMA) and Cerulean Cigar Adaptor (CCA). Specific fill patterns are used for each adaptor.
Figure 47:
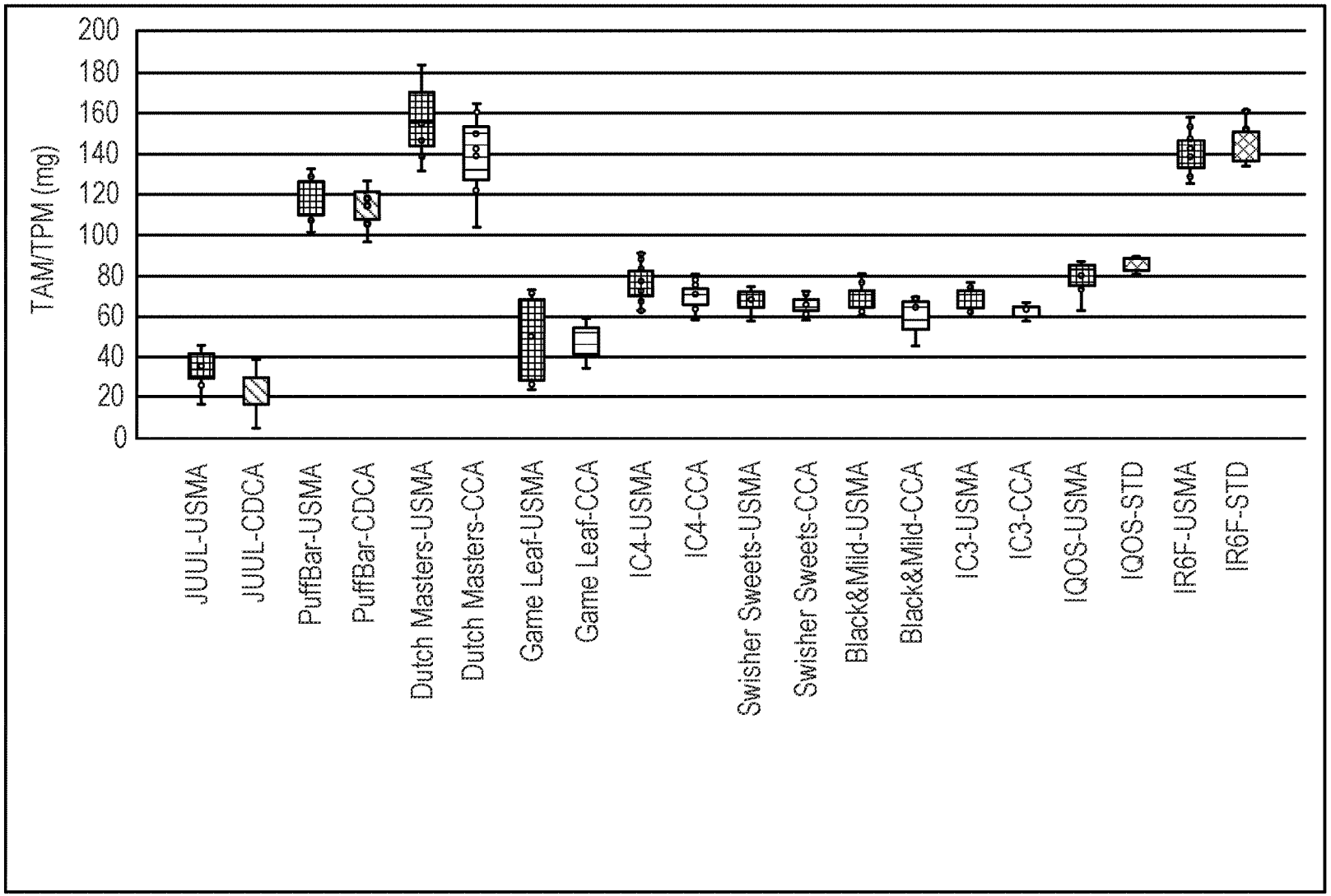
FIG. 47 shows a box plot comparison of the collected total particulate matter (TPM) from e-cigarettes (per vaping session of 15 puffs), cigars, cigarillos, IQOS, and 1R6F reference cigarette sampled using the universal smoking machine adaptor (USMA), CDC adaptor (CDCA), Cerulean Cigar Adaptor (CCA), and Cerulean standard cigarette adaptor (STD). Specific fill patterns are used for each adaptor.
Figure 48:
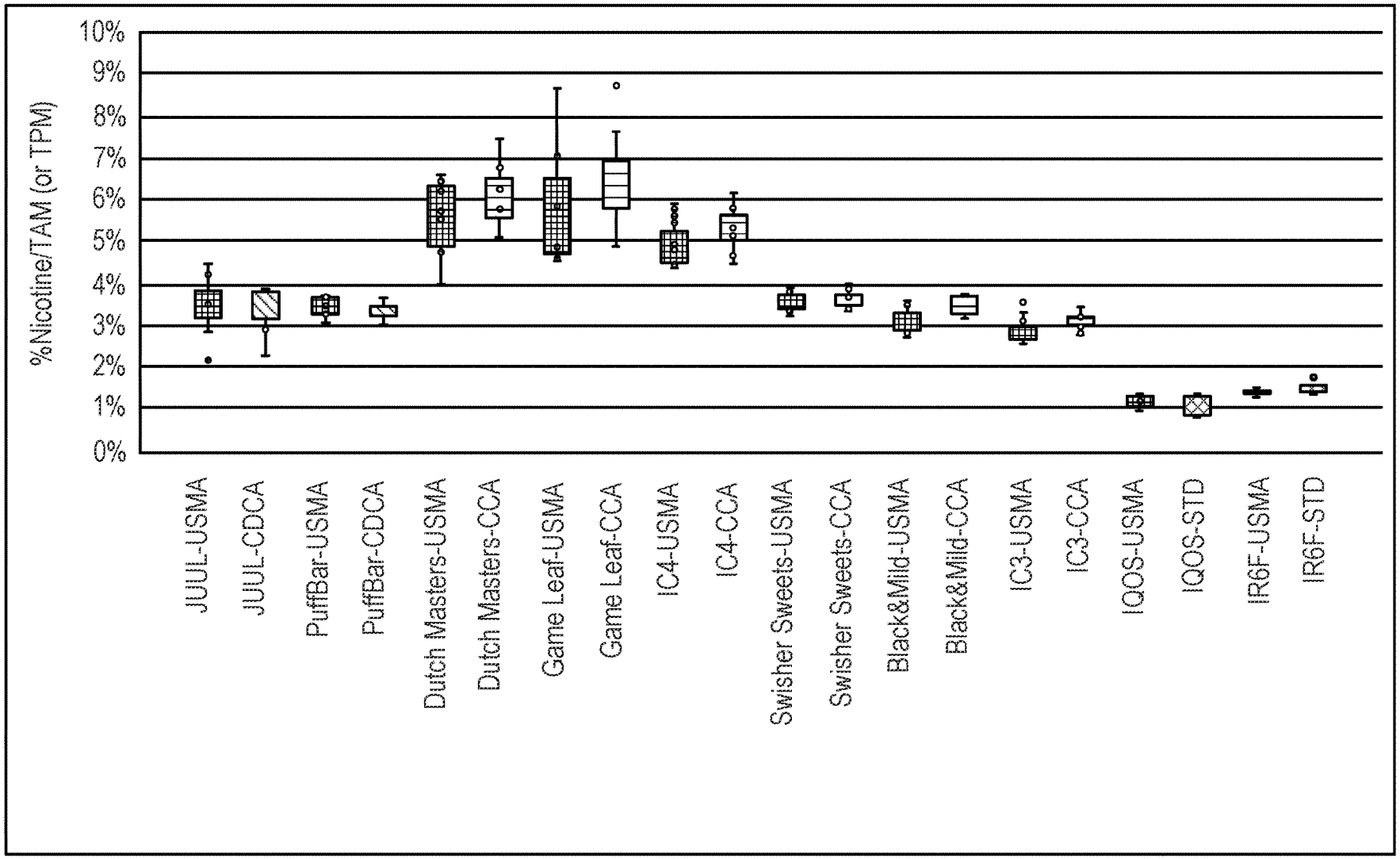
FIG. 48 shows a box plot comparison of the nicotine fraction in aerosol or particulate matter collected from e-cigarettes, cigars, cigarillos, IQOS, and 1R6F reference cigarette sampled using the universal smoking machine adaptor (USMA), CDC adaptor (CDCA), Cerulean Cigar Adaptor (CCA), and Cerulean standard cigarette adaptor (STD). Specific fill patterns are used for each adaptor.
Figure 49:
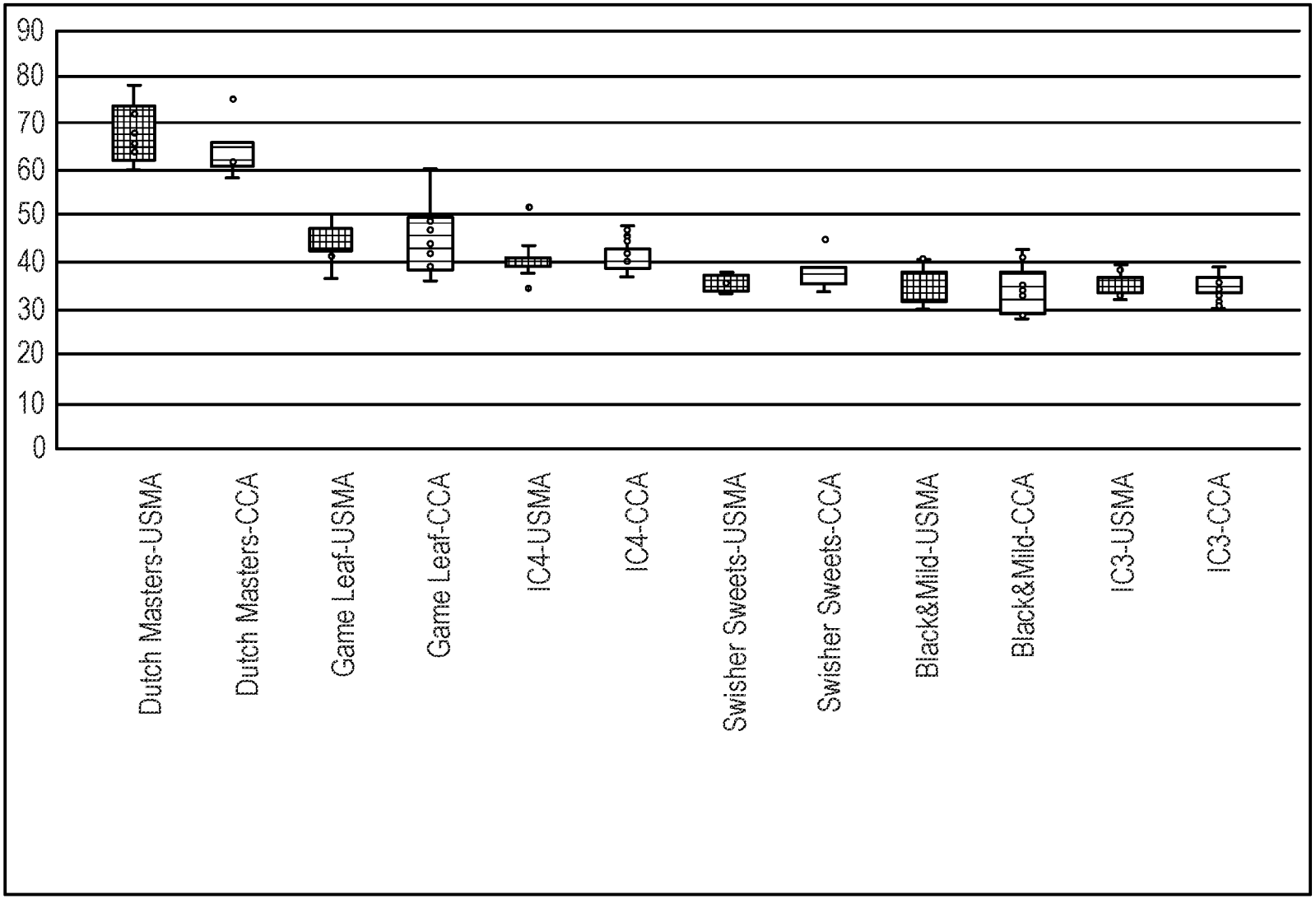
FIG. 49 shows a box plot comparison of the number of puffs per smoking session of cigars and cigarillos using the universal smoking machine adaptor (USMA) and Cerulean Cigar Adaptor (CCA). Specific fill patterns are used for each adaptor.

The distribution of the nicotine yield for all products tested by all adaptors is shown by the boxplots in FIG. 45; the median nicotine yield for most products was 2-4 mg/smoking or vaping session. Distributions were generally uniform around the median except for IQOS. Also, only Game Leaf and to a lesser extent Dutch Masters data showed a wider range when tested with USMA compared to other products. Box plots for product mass consumed, TPM, nicotine expressed as a fraction of TPM, and the number of puffs are shown in FIGS. 46-49.

Discussion

The USMA is user-friendly and versatile compared to the standard, commercially available adaptors, and has fewer parts and the ability to form a leak-tight seal on a wide variety of mouth-end geometries for conventional and newer tobacco products. This study demonstrates that the inert materials that the USMA is constructed from do not scavenge mainstream TPM. The USMA also did not perturb the aerosol flow path or increase TPM emissions by contamination. TPM was slightly higher (~6% on average) than the mass of e-cigarettes consumed; this was evident for both adaptors tested and could be due to the hygroscopicity of e-liquid constituents (propylene glycol and glycerol). The USMA also does not appear to scavenge nicotine. Nicotine mass fraction from JUUL and Puff Bar using both adaptors (USMA and CDCA) was ~3.5%, giving a nicotine transfer efficiency of ~70%, which is consistent with other studies.

Overall, the variability in the study's e-cigarette TPM emissions falls within 20%, which is consistent with other studies. For instances where the variability exceeds 20%, the study's results indicate that this is most likely due to tobacco product construction and not the USMA or the comparison adaptors. For example, the NJOY pod is only held in place with magnets and not a mechanical closure. Therefore, the possibility of it becoming disconnected from the battery may explain the variability seen for this product. Another example is the Reflex e-cigarette, for which leaking of e-liquid from the refillable pods was observed during testing. For disposable e-cigarettes, the mouth ends of the e-cigarettes tested are press fit with no sealing substance such as glue into the bodies of the device, and thus leakage of air can occur at that juncture. In previously reported work, the study all variables associated with the e-cigarette device, such as battery performance and air leakages, by vacuum testing the seal formed between the adaptors and the product mouth ends. Results indicate that the variability in emissions stems from the devices themselves, and not the seal between the USMA and the e-cigarettes' mouth ends.

The study also found good repeatability in TPM generated from cigars and cigarillos, except for one brand, Game Leaf. Under direct (unmagnified) observation, this cigar is not uniformly constructed, in that the packing density is highly variable, tobacco is prone to falling out of both ends when the cigar is handled, the porosity of the wrapper is not uniform, and it required frequent re-lighting during testing. The deviation of replicates from the mean for most cigar and cigarillo brands, including reference cigars, was narrower than the CORESTA intra-laboratory RSD ranges. Nicotine yield, nicotine fraction, and puff number data indicate that the USMA performs reliably and repeatably with these products. Also, cigar and cigarillo data distributions shown in FIG. 45 and FIGS. 46-49 are similar when generated using the USMA and the comparison adaptor. Thus, any lack of uniformity in these data implies that the variability is coming from the product characteristics and not the adaptors.

The TPM data from IQOS using both adaptors also showed acceptable repeatability. The variability in nicotine yield data may be stemming from variability in the heating achieved by the IQOS device or the concentration of the nicotine in the HeatSticks; nevertheless, variability was smaller when testing with the USMA versus the STD adaptor.

When testing a robustly made tobacco product, i.e., the combustible certified reference cigarette (1R6F), the precision and accuracy of the emissions generated using the USMA were excellent (Table 2). The variability when using the USMA fell within the certified uncertainty for the 1R6F for TPM (7.5%) and nicotine yield (6.8%), and data generated using the USMA were accurate (<5% error).

In this work, the study tested the prototype of a USMA with commercial tobacco products representing 5 product types, all having a wide range of different mouth-end geometries. The next steps include optimizing the design of the USMA ergonomically for greater ease-of-use and revising production methods to produce greater numbers of USMAs more readily. The study will subject the optimized, high production USMA to additional testing including particle size distribution of mainstream smoke/aerosol and selected mainstream harmful and potentially harmful constituents from the volatile phase. The final version of this adaptor will be commercially available to government, industry, commercial, and academic laboratories. The study findings should be interpreted considering limitations, including that these data were generated in one laboratory by a small team of analysts. Future steps should include emission testing by multiple laboratories of reference and commercial tobacco products using the USMA to assess reproducibility of results.

Conclusion

The ability to generate accurate and precise emissions data for the different tobacco products already in and yet to be introduced into the marketplace will significantly advance the field of tobacco product research and regulation. This study showed that the USMA fulfills that need by sealing effectively with a variety of tobacco products popularly used in the US. Use of the USMA resulted in repeatable, precise, and accurate mainstream TPM and nicotine data from pod-based e-cigarettes, disposable e-cigarettes, cigarillos, cigars, an HTP, and a certified reference cigarette—all products having different mouth-end geometries and compressibilities, product sizes, and masses. The TPM and nicotine emissions showed a lower error and greater and improved repeatability when testing the 1R6F-certified reference cigarette using the USMA compared to the STD adaptor. Comparisons to other in-house (CDCA) and commercial geometry-specific adaptors (CCA) indicated that the USMA performs similarly or better. The USMA is the only adaptor that can reliably seal with plastic-tipped cigarillos and a wide variety of e-cigarette mouth ends. These first promising results indicate that the enhanced versatility of the USMA is paralleled by its ability to generate precise and accurate emissions data.

Configuration of Certain Implementations

The construction and arrangement of the systems and methods as shown in the various implementations are illustrative only. Although only a few implementations have been described in detail in this disclosure, many modifications are possible (e.g., variations in sizes, dimensions, structures, shapes, and proportions of the various elements, values of parameters, mounting arrangements, use of materials, colors, orientations, etc.). For example, the position of elements may be reversed or otherwise varied, and the nature or number of discrete elements or positions may be altered or varied. Accordingly, all such modifications are intended to be included within the scope of the present disclosure. The order or sequence of any process or method steps may be varied or re-sequenced according to alternative implementations. Other substitutions, modifications, changes, and omissions may be made in the design, operating conditions, and arrangement of the implementations without departing from the scope of the present disclosure.

It is to be understood that the methods and systems are not limited to specific synthetic methods, specific components, or to particular compositions. It is also to be understood that the terminology used herein is for the purpose of describing particular implementations only and is not intended to be limiting.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another implementation includes from the one particular value and/or to the other particular value. Similarly, when values are expressed as approximations, by use of the antecedent "about," it will be understood that the particular value forms another implementation. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal implementation. "Such as" is not used in a restrictive sense, but for explanatory purposes.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific implementation or combination of implementations of the disclosed methods.

What is claimed is:

1. A smoking machine adaptor device comprising:

a base configured to couple to a smoking machine, the base defining a central axis and a base cavity;

a cap including a cap flange defining a cap aperture, and a cap actuator coupled to the base and configured to move the cap flange relative to the base along the central axis between a first position to a second position; and a resiliently deformable ferrule sized to be received within the base cavity and defining a ferrule aperture aligned axially with the cap aperture along the central axis, wherein the ferrule aperture defines a first ferrule area in a plane perpendicular to the central axis when the cap flange is in the first position, wherein the ferrule aperture defines a second ferrule area in the plane perpendicular to the central axis when the cap flange is in the second position, and wherein the second ferrule area is less than the first ferrule area such that, when the cap is in the second position, the ferrule engages and forms a seal with a smoking, vaping, or inhalation device disposed within the ferrule aperture.

2. The smoking machine adaptor device of claim 1, wherein the base further defines a filter cavity in fluid communication with the base cavity via a smoke passage therebetween; and the smoking machine adaptor device further comprising a filter disposed within the filter cavity of the base.

3. The smoking machine adaptor device of claim 1, wherein the cap is threadingly couplable to the base.

4. The smoking machine adaptor device of claim 1, wherein rotation of the cap relative to the base causes the cap to move between the first position to the second position.

5. The smoking machine adaptor device of claim 1, further comprising a compression plate disposed between the ferrule and the cap flange and defining a flange aperture aligned axially with the ferrule aperture and the cap aperture along the central axis.

6. The smoking machine adaptor device of claim 5, the compression plate further comprising a compression surface having a frustoconical shape that biases deformation of the ferrule toward the central axis.

7. The smoking machine adaptor device of claim 1, wherein the ferrule aperture is circular or oval shaped in the plane perpendicular to the central axis.

8. The smoking machine adaptor device of claim 1, wherein the ferrule is formed of a resiliently flexible urethane rubber material.

9. The smoking machine adaptor device of claim 1, wherein the ferrule deforms radially relative to the central axis to effectively decrease an area of the ferrule aperture as the cap moves from the first position to the second position.

10. The smoking machine adaptor device of claim 1, wherein the smoking, vaping, or inhalation device comprises a rigid mouthpiece or a compressible mouthpiece, either of which are engageable by the ferrule to form the seal.

11. The smoking machine adaptor device of claim 1, wherein, when the cap is in the second position, the second ferrule area matches a shape of the smoking, vaping, or inhalation device disposed therein.

12. A smoking machine adaptor kit comprising:

a base configured to couple to a smoking machine, the base defining a central axis and a base cavity;

a cap including a cap flange defining a cap aperture, and a cap actuator coupled to the base and configured to move the cap flange relative to the base along the central axis between a first position to a second position;

a first resiliently deformable ferrule sized to be received within the base cavity and defining a circular ferrule aperture configured to align axially with the cap aperture along the central axis, the circular ferrule aperture defining a first area when the cap is in the first position and a second, smaller area when the cap is in the second position such that, when the cap is in the second position, the first ferrule engages and forms a seal with a first smoking, vaping, or inhalation device disposed within the circular ferrule aperture; and a second resiliently deformable ferrule sized to be received within the base cavity and defining an oval ferrule aperture configured to align axially with the cap aperture along the central axis, the oval ferrule aperture defining a first area when the cap is in the first position and a second, smaller area when the cap is in the second position such that, when the cap is in the second position, the second ferrule engages and forms a seal with a second smoking, vaping, or inhalation device disposed within the oval ferrule aperture.

13. The smoking machine adaptor kit of claim 12, further comprising a second base configured to couple to the smoking machine, the base structured to receive a first filter and the second base structured to receive a second filter different from the first filter.

14. The smoking machine adaptor kit of claim 12, further comprising a filter holder coupled to the base and configured to secure a filter between the base and the filter holder.

15. The smoking machine adaptor kit of claim 12, further comprising:

a first compression plate including a circular plate aperture corresponding to the circular ferrule aperture of the first resiliently deformable ferrule; and a second compression plate including an oval plate aperture corresponding to the oval ferrule aperture of the second resiliently deformable ferrule.

16. The smoking machine adaptor kit of claim 15, wherein the first compression plate further comprises a compression surface having a frustoconical shape that biases deformation of the first ferrule toward the central axis.

17. The smoking machine adaptor kit of claim 12, further comprising:

a third resiliently deformable ferrule sized to be received within the base cavity and defining a small circular ferrule aperture configured to align axially with the cap aperture along the central axis, the small circular ferrule aperture defining a smaller area than the circular ferrule aperture; and a fourth resiliently deformable ferrule sized to be received within the base cavity and defining a small oval ferrule aperture configured to align axially with the cap aperture along the central axis, the small oval ferrule aperture defining a smaller area than the oval ferrule aperture.

18. The smoking machine adaptor kit of claim 12, wherein the first smoking, vaping, or inhalation device comprises a compressible mouthpiece and the second smoking or vaping device comprises a rigid mouthpiece.

19. The smoking machine adaptor kit of claim 12, wherein, when the cap is in the second position, the second area of the oval ferrule aperture matches a shape of the second smoking, vaping, or inhalation device disposed therein.

* * * * *